US006465166B1

(12) United States Patent
Kobayashi et al.

(10) Patent No.: US 6,465,166 B1
(45) Date of Patent: Oct. 15, 2002

(54) METHINE COMPOUND AND SILVER HALIDE PHOTOGRAPHIC MATERIAL

(75) Inventors: Katsumi Kobayashi; Takanori Hioki, both of Kanagawa (JP)

(73) Assignee: Fuji Photo Film. Co., Ltd., Kanagawa (JP)

( * ) Notice: Subject to any disclaimer, the term of this patent is extended or adjusted under 35 U.S.C. 154(b) by 0 days.

(21) Appl. No.: 09/717,224

(22) Filed: Nov. 22, 2000

(30) Foreign Application Priority Data

Nov. 22, 1999 (JP) ..... 11-331571

(51) Int. Cl.[7] ..... G03C 1/005; G03C 1/494

(52) U.S. Cl. ..... 430/581; 430/582; 430/583; 430/584; 430/585; 430/586; 430/587; 430/588; 430/570

(58) Field of Search ..... 430/581, 582, 430/583, 584, 585, 586, 587, 588, 570

(56) References Cited

U.S. PATENT DOCUMENTS

| | | | | |
|---|---|---|---|---|
| 5,273,866 A | * | 12/1993 | Fujita et al. | 430/570 |
| 5,278,037 A | * | 1/1994 | Karino | 430/513 |
| 5,422,238 A | | 6/1995 | Ikegawa et al. | 430/583 |
| 6,143,486 A | * | 7/2000 | Parton et al. | 430/583 |
| 6,165,703 A | * | 12/2000 | Parton et al. | 430/583 |

FOREIGN PATENT DOCUMENTS

EP 0 838 719 A2 4/1998

* cited by examiner

*Primary Examiner*—Geraldine Letscher

(74) *Attorney, Agent, or Firm*—Sughrue Mion, PLLC

(57) ABSTRACT

Compounds represented by formula (I) and silver halide photographic materials comprising these compounds:

(I)

wherein $Q_1$ represents a methine or polymethine group necessary for completing the compound as a methine dye; $Z_1$ represents atoms necessary to complete a 5- or 6-membered nitrogen-containing heterocyclic ring, provided that $Z_1$ may be condensed with a ring; $L_1$ and $L_2$ each represent a methine group; $p_1$ represents 0 or 1; L represents a divalent linking group and Ar represents an aromatic group, provided that L or Ar contains at least one proton dissociative group as a substituent group or a part of the linkage or aromatic group and the proton dissociative group has a pKa value of from 3 to 12; $M_1$ represents a counter ion for charge balance; and $m_1$ represents a number of counter ions required for neutralizing charges on the molecule, and ranges from 0 to 10.

24 Claims, No Drawings

METHINE COMPOUND AND SILVER HALIDE PHOTOGRAPHIC MATERIAL

FIELD OF THE INVENTION

The present invention relates to a spectrally sensitized silver halide photographic emulsion and a photographic light-sensitive material using such an emulsion.

BACKGROUND OF THE INVENTION

Hitherto, considerable efforts have been made to increase the sensitivities of silver halide photographic materials. The silver halide photographic emulsions constituting a photographic material get sensitivities through a mechanism that the sensitizing dyes adsorbed to the surfaces of silver halide grains absorb light incident on the photographic material and the light energy absorbed by the dyes is transferred to the silver halide grains. In the spectral sensitization of silver halide, therefore, an increase in spectral sensitivity is thought to be achieved by raising the light-absorption rate per unit grain surface area of silver halide grains to increase the light energy transferred to silver halide. In order to raise the light-absorption rate on the silver halide grain surface, it would be proper to increase the quantity of spectral sensitizing dye adsorbed per unit grain surface area.

However, there is a limit to a quantity of sensitizing dye adsorbed to the silver halide grain surface, and so it is difficult to make dye chromophores adsorb to the grain surface in a quantity larger than the quantity for saturated adsorption in a state of single layer (namely one-layer adsorption). Accordingly, the absorption rate of incident photons by individual silver halide grains in a spectral sensitization region is still low under present conditions.

The methods hitherto proposed to solve such a problem are described below.

According to the method proposed by P. B. Gilman, Jr. et al. in *Photographic Science and Engineering,* vol. 20, No. 3, p. 97 (1976), a cationic dye is adsorbed as the first layer and then the second layer is formed by making an anionic dye adsorb to the cationic dye through the use of electrostatic force.

In the method disclosed by G. B. Bird et al. in U.S. Pat. No. 3,622,316, dyes of many kinds are adsorbed to silver halide in a multi-layer state, and the silver halide is sensitized by contribution of Forster-type excited energy transfer.

In JP-A-63-138341 and JP-A-64-84244 (the term "JP-A" as used herein means an "unexamined published Japanese patent application"), Sugimoto et al. disclose the spectral sensitization by energy transfer from luminescent dyes.

The attempt at spectral sensitization by energy transfer from gelatin-substituted cyanine dyes is reported by R. Steiger in *Photographic Science and Engineering,* vol. 27, No. 2, p. 59 (1983).

Ikegawa et al. disclose in JP-A-61-251842 the spectral sensitization by energy transfer from cyclodextrin-substituted dyes.

The dyes having in each molecule two separate chromophores which are not conjugated but connected together by covalent bond(s), or the so-called connecting dyes, are disclosed in, e.g., U.S. Pat. Nos. 2,393,351, 2,425,772, 2,518,732, 2,521,944 and 2,592,196, and European Patent 565,083. Therein, however, those dyes are not aimed at an increase in light-absorption rate. As to the cases aimed positively at improvement in light-absorption rate, the attempts to increase the light-absorption rate by adsorption of connected sensitizing dye molecules having plural cyanine chromophores per molecule and achieve sensitization by contribution of energy transfer are disclosed by G. B. Bird, A. L. Borror et al. in U.S. Pat. Nos. 3,622,317 and 3,976,493.

In JP-A-64-91134, Ukai, Okazaki and Sugimoto advance the proposal to bind at least one substantially non-adsorptive cyanine, merocyanine or hemicyanine dye having at least two sulfo and/or carboxyl groups to a spectral sensitizing dye which can be adsorbed to silver halide.

On the other hand, L. C. Vishwakarma discloses in JP-A-6-57235 the method of synthesizing connecting dyes by dehydration condensation of two dyes. Further, he discloses in JP-A-6-27578 that the connecting dye consisting of a monomethinecyanine and a pentamethineoxonol has red sensitivity. In this case, however, there is no overlap between the luminescence of the oxonol and the absorption of the cyanine, and so the spectral sensitization by excited energy transfer of Förster type is not caused between dye moieties; as a result, there is no hope of an increase in sensitivity by light-condensing action of oxonol.

Further, the connecting dyes having special linking groups are proposed by R. L. Parton et al. in EP-A1-887700.

In addition, the spectral sensitization by cyanine dye polymers are proposed by M. R. Roberts et al. in U.S. Pat. No. 4,950,587.

As mentioned above, a large number of studies have so far been made for the purpose of improving the light-absorption rate, but any of them fails in achieving a sufficient effect of increasing light-absorption rate as well as satisfactory increase in sensitivity.

In the case of color photosensitive materials, it is further required to put their spectral sensitivities in the intended wavelength regions. For spectrally sensitizing a silver halide photosensitive material, the absorption of a sensitizing dye in a state of monomer is not used, but the J-band formed upon adsorption of sensitizing dyes to the surface of silver halide grains is generally utilized. The J-band has a very sharp absorption at wavelengths shifted to the longer wavelength side than the wavelengths at which the dye monomer shows its absorption. Therefore, the J-band is very useful for putting both light-absorption and spectral sensitivity in the desired wavelength region. Even if the adsorption of sensitizing dye to the grain surface in a multiple layer enables an increase in light-absorption rate, the sensitizing dye exhibits very broad absorption so far as the dye which is not directly adsorbed to silver halide grains, namely the dye forming the second layer and above, is in a state of monomer. Accordingly, the adsorption in a monomer state cannot impart practical spectral sensitivity to photosensitive materials.

On the other hand, each of color sensitive regions has a width of about 100 nm, and it is undesirable that greater differences than needed arise between the sensitivities to rays of light in the foregoing wavelength region.

Under these circumstances, it has been desired to develop arts of confining the absorption and the spectral sensitivity within the desired width of each color sensitive region, and besides, reducing variations in spectral absorptivity and sensitivity as greatly as possible in regard to the light of the foregoing wavelength region while increasing the areal intensity of light absorption per unit grain surface area by multi-layer adsorption of sensitizing dye to the silver halide grain surface.

On the other hand, it has been found that silver halide grains tend to agglomerate when sensitizing dye is adsorbed to the grain surface in a multiple layer, because the quantity of gelatin adsorbed is decreased to lower protective colloid ability. Therefore, it has also been desired to develop arts of achieving both multi-layer adsorption of sensitizing dye and control of grain agglomeration.

As a method for fulfilling those desires, we have already found the method of using an aromatic group-containing dye or the method of using an aromatic group-containing cationic dye in combination with an anionic dye, as disclosed in JP-A-10-239789, JP-A-8-269009, JP-A-10-123650 and JP-A-8-328189. However, such a method uses a highly hydrophobic dye as sensitizing dyes, so that it has a problem of causing a high level of residual color of dyes after processing, as compared with the cases of using conventional sensitizing dyes.

SUMMARY OF THE INVENTION

Therefore, one object of the present invention is to provide a high speed silver halide photographic emulsion wherein the grain agglomeration is prevented, and at the same time to provide a photographic light-sensitive material comprising such an emulsion, and further to provide a silver halide photographic material which is reduced in residual color of dyes after processing.

Another object of the invention is to provide a methine dye having potential usefulness for not only silver halide photographic materials but also photoelectron functional materials.

These objects are attained with the following embodiments (1) to (11) of the invention:

(1) A compound represented by formula (I):

(I)

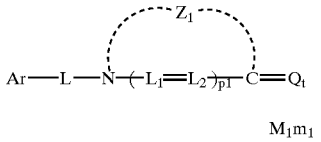

wherein $Q_1$represents a methine or polymethine group necessary for completing the compound as a methine dye; $Z_1$ represents atoms necessary to complete a 5- or 6-membered nitrogen-containing heterocyclic ring, provided that $Z_1$ may be condensed with a ring; $L_1$ and $L_2$ each represent a methine group; $P_1$ represents 0 or 1; L represents a divalent linking group and Ar represents an aromatic group, provided that L or Ar contains at least one proton dissociative group as a substituent group or a part of the linking group or aromatic group and the proton dissociative group has a pKa value of from 3 to 12; $M_1$ represents a counter ion for charge balance; and $m_1$ represents a number of counter ions required for neutralizing charges on the molecule, and ranges from 0 to 10.

(2) The compound according to Embodiment (1), wherein the compound represented by formula (I) is a compound represented by formula (II):

(II)

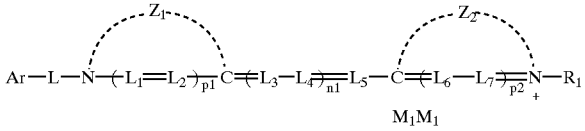

wherein $Z_2$ represents atoms necessary to complete a 5- or 6-membered nitrogen-containing heterocyclic ring, provided that $Z_2$ may be condensed with a ring; $L_3$, $L_4$, $L_5$, $L_6$ and $L_7$ each represent a methine group; $R_1$ represents an alkyl group, an aryl group, or a heterocyclic group; $P_2$ represents 0 or 1; $n_1$ represents 0, 1, 2, 3 or 4; and $Z_1$, $L_1$, $L_2$, $P_1$, L, Ar, $M_1$ and $m_1$ have the same meanings as in the formula (I) respectively.

(3) The silver halide photographic material comprising at least one compound as defined in Embodiment (1) or Embodiment (2).

(4) A silver halide photographic emulsion comprising silver halide grains having a light absorption intensity of at least 60 at the spectral absorption maximum wavelength of less than 500 nm, or having a light absorption intensity of at least 100 at the spectral absorption maximum wavelength of not less than 500 nm, and at least one compound represented by the formula (I) defined in Embodiment (1) or the formula (II) defined in Embodiment (2).

(5) The silver halide photographic emulsion as described in Embodiment (4), wherein when the maximum value of the spectral absorption rate of the emulsion due to the sensitizing dye is taken as Amax, a wavelength interval between the shortest wavelength and the longest wavelength showing 50% of Amax is 120 nm or less.

(6) The silver halide photographic emulsion as described in Embodiment (4), wherein when the maximum value of the spectral sensitivity of the emulsion due to the sensitizing dye is taken as Smax, a wavelength interval between the shortest wavelength and the longest wavelength showing 50% of Smax is 120 nm or less.

(7) The silver halide photographic emulsion as described in Embodiment (5), wherein a wavelength interval between the shortest wavelength and the longest wavelength showing 80% of Amax is 20 nm or more and the wavelength interval between the shortest wavelength and the longest wavelength showing 50% of Amax is 120 nm or less.

(8) The silver halide photographic emulsion as described in Embodiment (6), wherein the wavelength interval between the shortest wavelength and the longest wavelength showing 80% of Smax is 20 nm or more and the wavelength interval between the shortest wavelength and the longest wavelength showing 50% of Smax is 120 nm or less.

(9) A silver halide photographic material having at least one silver halide emulsion layer, with the emulsion layer comprising a silver halide photographic emulsion as described in any of Embodiments (4) to (8).

(10) A method for preparing a silver halide photographic emulsion, which comprises a step of adding a compound represented by the formula (I) defined in Embodiment (1) or the formula (II) defined in Embodiment (2) to a silver halide photographic emulsion having a pH value higher than the pKa value of first or second dissociation of a proton dissociative group contained in the compound represented by the foregoing formula (I) or (II) and a step of adjusting the pH of the compound-added emulsion to a value lower than the pKa value of first or second dissociation of the proton dissociative group.

(11) A silver halide photographic material comprising a silver halide emulsion prepared by a method according to Embodiment (10).

DETAILED DESCRIPTION OF THE INVENTION

Compounds represented by formula (I) or (II) are illustrated below in detail.

In formulae (I) and (II), $Z_1$ and $Z_2$ each represent atoms necessary to complete a 5- or 6-membered nitrogen-containing heterocyclic ring, provided that $Z_1$ and $Z_2$ each may be condensed with a ring. The ring to be condensed may be either aromatic or non-aromatic ring, preferably is an aromatic ring. Examples of the ring include an aromatic hydrocarbon ring such as a benzene ring and a naphthalene ring, and an aromatic heterocyclic ring such as a pyridine ring and a thiophene ring. Examples of $Z_1$ and $Z_2$ each include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus.

Of those nuclei, $Z_1$ and $Z_2$ each is preferably benzoxazole, benzothiazole, benzimidazole and quinoline nuclei. In particular, it is advantageous for $Z_1$ and $Z_2$ each to be a benzoxazole, benzimidazole or benzothiazole nucleus.

The 5- or 6-membered nitrogen-containing heterocyclic ring represented by $Z_1$ and $Z_2$ each may have a substituent, which is represented by V, hereinafter. Examples of the substituent V, though they have no particular restriction, include halogen atoms (e.g., chlorine, bromine, iodine, fluorine), a mercapto group, a cyano group, a carboxyl group, a phosphoric acid group, a sulfo group, a hydroxyl group, carbamoyl groups containing 1 to 10, preferably 2 to 8, particularly preferably 2 to 5, carbon atoms (e.g., methylcarbamoyl, ethylcarbamoyl, morpholinocarbonyl), sulfamoyl groups containing 0 to 10, preferably 2 to 8, particularly preferably 2 to 5, carbon atoms (e.g., methylsulfamoyl, ethylsulfamoyl, piperidinosulfonyl), a nitro group, alkoxy groups containing 1 to 20, preferably 1 to 10, particularly preferably 1 to 8, carbon atoms (e.g., methoxy, ethoxy, 2-methoxyethoxy, 2-phenylethoxy), aryloxy groups containing 6 to 20, preferably 6 to 12, particularly preferably 6 to 10, carbon atoms (e.g., phenoxy, p-methylphenoxy, p-chlorophenoxy, naphthoxy), acyl groups containing 1 to 20, preferably 2 to 12, particularly preferably 2 to 8, carbon atoms (e.g., acetyl, benzoyl, trichloroacetyl), acyloxy groups containing 1 to 20, preferably 2 to 12, particularly preferably 2 to 8, carbon atoms (e.g., acetyloxy, benzoyloxy), acylamino groups containing 1 to 20, preferably 2 to 12, particularly preferably 2 to 8, carbon atoms (e.g., acetylamino), sulfonyl groups containing 1 to 20, preferably 1 to 10, particularly preferably 1 to 8, carbon atoms (e.g., methanesulfonyl, ethanesulfonyl, benzenesulfonyl), sulfinyl groups containing 1 to 20, preferably 1 to 10, particularly preferably 1 to 8, carbon atoms (e.g., methanesulfinyl, ethanesulfinyl, benzenesulfinyl), sulfonylamino groups containing 1 to 20, preferably 1 to 10, particularly preferably 1 to 8, carbon atoms (e.g., methanesulfonylamino, ethanesulfonylamino, benzenesulfonylamino), an amino group and substituted amino groups containing 1 to 20, preferably 1 to 12, particularly preferably 1 to 8, carbon atoms (e.g., methylamino, dimethylamino, benzylamino, anilino, diphenylamino), ammonium groups containing 0 to 15, preferably 3 to 10, particularly preferably 3 to 6, carbon atoms (e.g., trimethylammonium, triethylammonium), hydrazino groups containing 0 to 15, preferably 1 to 10, particularly preferably 1 to 6, carbon atoms (e.g., trimethylhydrazino), ureido groups containing 1 to 15, preferably 1 to 10, particularly preferably 1 to 6, carbon atoms (e.g., ureido, N,N-dimethylureido), imido groups containing 1 to 15, preferably 1 to 10, particularly preferably 1 to 6, carbon atoms (e.g., succinimido), alkylthio groups containing 1 to 20, preferably 1 to 12, particularly preferably 1 to 8, carbon atoms (e.g., methylthio, ethylthio, propylthio), arylthio groups containing 6 to 20, preferably 6 to 12, particularly preferably 6 to 10, carbon atoms (e.g., phenylthio, p-methylphenylthio, p-chlorophenylthio, 2-pyridylthio, naphthylthio), alkoxycarbonyl groups containing 2 to 20, preferably 2 to 12, particularly preferably 2 to 8, carbon atoms (e.g., methoxycarbonyl, ethoxycarbonyl, 2-benzyloxycarbonyl), aryloxycarbonyl groups containing 6 to 20, preferably 6 to 12, particularly preferably 6 to 10, carbon atoms (e.g., phenoxycarbonyl), unsubstituted alkyl groups containing 1 to 18, preferably 1 to 10, particularly preferably 1 to 5, carbon atoms (e.g., methyl, ethyl, propyl, butyl), substituted alkyl groups containing 1 to 18, preferably 1 to 10, particularly preferably 1 to 5, carbon atoms (including, e.g., hydroxymethyl, trifluoromethyl, benzyl, carboxyethyl, ethoxycarbonylmethyl and acetylaminomethyl, and besides expediently unsaturated hydrocarbon groups containing 2 to 18, preferably 3 to 10, particularly preferably 3 to 5, carbon atoms (e.g., vinyl, ethynyl, 1-cyclohexenyl, benzylidyne, benzylidene)), substituted or unsubstituted aryl groups containing 6 to 20, preferably 6 to 15, particularly preferably 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), substituted or unsubstituted heterocyclic groups containing 1 to 20, preferably 2 to 10, particularly preferably 4 to 6, carbon atoms (e.g., pyridyl, 5-methylpyridyl, thienyl, furyl, morpholino, teterahydrofurfuryl). These heterocyclic groups each may also have a benzene- or naphthalene-condensed ring structure.

Those substituent groups each may further be substituted with any of the groups mentioned above as examples of a substituent V.

Of the substituents described above as V, which can be present on a 5- or 6-membered nitrogen-containing heterocyclic ring represented by $Z_1$ and $Z_2$ each, an alkyl group, an aryl group, an alkoxy group, a halogen atom and a benzene-condensed ring are preferred. In particular, methyl group, phenyl group, methoxy group, chlorine atom, bromine atom, iodine atom and benzene-condensed ring are preferable.

$R_1$ is an alkyl group, an aryl group or a heterocyclic group. Suitable examples of these groups include unsubstituted alkyl groups containing 1 to 18, preferably 1 to 7, particularly preferably 1 to 4, carbon atoms (such as methyl, ethyl, propyl, isopropyl, butyl, isobutyl, hexyl, octyl, dodecyl and octadecyl groups), substituted alkyl groups containing 1 to 18, preferably 1 to 7, particularly preferably 1 to 4, carbon atoms [such as alkyl groups substituted with groups as mentioned above as examples of the substituent V, preferably including aralkyl groups (e.g., benzyl, 2-phenylethyl), unsaturated hydrocarbon groups (e.g., allyl), hydroxyalkyl groups (e.g., 2-hydroxyethyl, 3-hydroxypropyl), carboxyalkyl groups (e.g., 2-carboxyethyl, 3-carboxypropyl, 4-carboxybutyl, carboxymethyl), alkoxyalkyl groups (e.g., 2-methoxyethyl, 2-(2-methoxyethyl)ethyl), aryloxyalkyl groups (e.g., 2-phenoxyethyl, 2-(l-naphthoxy)ethyl), alkoxycarbonylalkyl groups (e.g., ethoxycarbonylmethyl, 2-benzyloxycarbonylethyl), aryloxycarbonylalkyl groups (e.g., 3-phenoxycarbonylpropyl), acyloxyalkyl groups (e.g., 2-acetyloxyethyl), acylalkyl groups (e.g., 2-acetylethyl), carbamoylalkyl groups (e.g., 2-morpholinocarbonylethyl), sulfamoylalkyl groups (e.g., N,N-dimethylsulfamoylmethyl), sulfoalkyl groups (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), sulfoalkenyl groups, sulfatoalkyl groups (e.g., 2-sulfatoethyl, 3-sulfatopropyl, 4-sulfatobutyl), heterocyclic ring-substituted alkyl groups (e.g., 2-(pyrrolidin-2-one-1-yl)ethyl, tetrahydrofurfuryl), and alkylsulfonyl-carbamoylmethyl groups (e.g., methanesulfonylcarbamoyl-methyl)], unsubstituted aryl groups containing 6 to 20, preferably 6 to 10, particularly preferably 6 to 8, carbon atoms (such as phenyl and 1-naphthyl groups), substituted aryl groups containing 6 to 20, preferably 6 to 10, particularly preferably 6 to 8, carbon atoms (such as aryl groups substituted with groups mentioned above as examples of the substituent V, specifically including p-methoxyphenyl, p-methylphenyl and p-chlorophenyl groups), unsubstituted heterocyclic groups containing 1 to 20, preferably 3 to 10, particularly preferably 4 to 8, carbon atoms (such as 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2- (1,3,5-triazolyl), 3-(1,2,4-triazolyl) and 5-tetrazolyl groups), and substituted heterocyclic groups containing 1 to 20, preferably 3 to 10, particularly preferably 4 to 8, carbon atoms (such as heterocyclic groups substituted with groups mentioned above as examples of the substituent V, specifically including 5-methyl-2-thienyl and 4-methoxy-2-pyridyl groups).

$L_1$, $L_2$, $L_3$, $L_4$, $L_5$, $L_6$ and $L_7$ each represent a methine group, which may have a substituent. Examples of such a substituent include substituted or unsubstituted alkyl groups containing 1 to 15, preferably 1 to 10, particularly preferably 1 to 5, carbon atoms (such as methyl, ethyl and 2-carboxyethyl groups) substituted or unsubstituted aryl groups containing 6 to 20, preferably 6 to 15, particularly preferably 6 to 10, carbon atoms (such as phenyl and o-carboxyphenyl groups), substituted or unsubstituted heterocyclic groups containing 3 to 20, preferably 4 to 15, particularly preferably 6 to 10, carbon atoms (such as N,N-dimethylbarbituric acid group), halogen atoms (such as chlorine, bromine, iodine and fluorine), alkoxy groups containing 1 to 15, preferably 1 to 10, particularly preferably 1 to 5, carbon atoms (such as methoxy and ethoxy groups), amino groups containing 0 to 15, preferably 2 to 10, particularly preferably 4 to 10, carbon atoms (such as methylamino, N,N-dimethylamino, N-methyl-N-phenylamino and N-methylpiperazino groups), alkylthio groups containing 1 to 15, preferably 1 to 10, particularly preferably 1 to 5, carbon atoms (such as methylthio and ethylthio groups) and arylthio groups containing 6 to 20, preferably 6 to 12, particularly preferably 6 to 10, carbon atoms (such as phenylthio and p-methylphenylthio groups). Each methine group may form a ring together with another methine group, or it can form an auxochrome ring.

L represents a divalent linking group or a single bond. Such a linking group is constituted of one or more atoms selected from carbon, nitrogen, sulfur and oxygen atoms. Suitable examples of such a linking group include an alkylene group (such as methylene, ethylene, propylene, butylene or pentylene), an arylene group (such as phenylene or naphthylene), an alkenylene group (such as ethenylene or propenylene), an alkynylene group (such as ethynylene or propynylene), an amido group, an ester group, a sulfonamide group, a sulfonic acid ester group, a ureid group, a sulfonyl group, a sulfinyl group, a thioether group, an ether group, carbonyl group, —N(Ra)— (wherein Ra is a hydrogen atom, a substituted or unsubstituted alkyl group, or a substituted or unsubstituted aryl group), a divalent heterocyclic group (such as 6-chloro-1,3,5-triazine-2,4-diyl, pyrimidine-2,4-diyl and quinoxaline-2,3-diyl), and a divalent linking group which is formed by one or more of the above-described groups and contains 0 to 100, preferably 1 to 20, carbon atoms.

Additionally, the linking groups as described above may be substituted with groups as mentioned above as examples of V.

Preferably, L is an alkylene group containing 1 to 10 carbon atoms (e.g., methylene, ethylene, propylene, butylene), an arylene group containing 6 to 10 carbon atoms (e.g., phenylene, naphthylene), an alkenylene group containing 10 carbon atoms or less (e.g., ethenylene, propenylene), an alkynylene group containing 10 carbon atoms or less (e.g., ethynylene, propynylene), an ether group, an amido group, an ester group, a sulfonamide group, a sulfonic acid group, or a divalent group which is formed by combining one or more of the above-described groups and contains 1 to 10 carbon atoms.

In particular, it is desirable for L to contain a proton dissociative group having its pKa in the range of 3 to 12. Such a proton dissociative group has no particular restriction, except that the pKa thereof is from 3 to 12. For ensuring the dye stability, however, the compound in a dissociated state is required to have sufficiently low nucleophilicity. Examples of a proton dissociative group satisfying such a requirement include a carboxyl group, a sulfonylcarbamoyl group, a sulfonylsulfamoyl group, a carbonylcarbamoyl group, a carbonylsulfamoyl group and a phenolic hydroxyl group. Of these groups, sulfonylcarbamoyl, sulfonylsulfamoyl, carbonylcarbamoyl and carbonylsulfamoyl groups are preferred. The partial structural formulae of preferred proton dissociative groups are shown below:

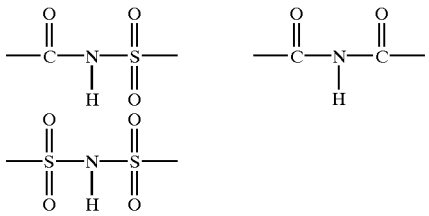

With proviso that these formulae involve the formulae showing a state that the proton on the nitrogen atom present is dissociated.

The group most suitable as L is a divalent linking group with 1 to 10 carbon atoms containing any of the proton dissociative groups shown above in combination with at least one group selected from the alkylene groups described above (e.g., methylene, ethylene, propylene, butylene), arylene groups with 6 to 10 carbon atoms (e.g., phenylene, naphthylene), alkenylene groups with 10 carbon atoms or less (e.g. , ethenylene, propenylene), alkynylene groups with 10 carbon atoms or less (e.g., ethynylene, propynylene), an ether group, an amido group, an ester group, a sulfon amide group and a sulfonic acid ester group.

Ar represents an aromatic group such as an aromatic hydrocarbon group or an aromatic heterocyclic group. Such an aromatic group may further have a substituent, or the ring may be a condensed with a ring. Examples of such an aromatic heterocyclic group include benzene, naphthalene, anthracene, phenanthrene, fluorene, triphenylene, naphthacene, biphenyl and terphenyl. Examples of such an aromatic heterocyclic ring include pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, cinnoline, carbazole, phenanthridine, acridine, phenanthroline, thianthrene, chromene, xanthene, phenoxthine, phenothiazine and phenazine. Preferably, Ar represents an aromatic hydrocarbon group, particularly a phenyl or naphthyl group, which may have a substituent.

Further, it is especially desirable for Ar to have on its aromatic ring a proton dissociative group whose pKa is in the range of 3 to 12. Such a proton dissociative group has no particular restriction, except that the pKa thereof is from 3 to 12. For ensuring the dye stability, however, the compound in a dissociated state is required to have sufficiently low nucleophilicity. Examples of a proton dissociative group satisfying such a requirement include a carboxyl group, a sulfonylcarbamoyl group, a sulfonylsulfamoyl group, a carbonylcarbamoyl group, a carbonylsulfamoyl group and a phenolic hydroxyl group. Of these groups, sulfonylcarbamoyl, sulfonylsulfamoyl, carbonylcarbamoyl and carbonylsulfamoyl groups are preferred. More specifically, the most suitable Ar is a phenyl or naphthyl group substituted by a proton dissociative group as described above.

With proviso that the compounds of formulae (I) and (II) can fall within the scope of the present compounds so far as either L alone or Ar alone contains a proton dissociative group. Of course, both Ar and L may contain proton dissociative groups.

$n_1$ represents 0, 1, 2, 3 or 4, preferably 0, 1 or 2, particularly preferably 0 or 1. When $n_1$ is from 2 to 4, methine groups are repeated, but they are not required to be the same.

p1 and p2 are each 0 or 1, preferably 0.

$M_1$ is contained in formulae (I) and (II) for showing the presence of cation or anion when there is the necessity of neutralizing ionic charges of each molecule. Examples of a typical cation include hydrogen ion ($H^+$), inorganic ions such as alkalimetal ions (e.g., $Na^+$, $K^+$, $Li^+$) and alkaline earth metal ions (e.g., $Ca^{2+}$), and organic ions such as ammonium ions (e.g., ammonium ion, tetraalkylammonium ions, pyridinium ion, ethylpyridinium ion). The anion also may be inorganic or organic, with examples including halide anions (such as fluoride, chloride, bromide and iodide ions), substituted arylsulfonate ions (such as p-toluenesulfonate and p-chlorobenzenesulfonate ions), aryldisulfonate ions (such as 1,3-benzenedisulfonate, 1,5-naphthalenedisulfonate and 2,6-naphthalenedisulfonate ions), alkylsulfate ions (such as methylsulfate ion) sulfate ion, thiocyanate ion, perchlorate ion, tetrafluoroborate ion, picrate ion, acetate ion and trifluoromethanesulfonate ion. In addition, $M_1$ may be an ionic polymer or a molecule having the opposite charge.

$m_1$ represents the number required for attaining the charge balance, and it is 0 when an inner salt is formed. Preferably, $m_1$ is 0.

$Q_1$ enables the formation of any type of methine dye. Examples thereof include a cyanine dye, a merocyanine dye, a rhodacyanine dye, a trinuclear merocyanine dye, an allopolar dye, a hemicyanine dye or a styryl dye. The details of these dyes are described in, e.g., F. M. Harmer, *Heterocyclic Compounds—Cyanine Dyes and Related Compounds,* John Wiley & Sons, New York and London (1964), and D. M. Sturmer, *Heterocyclic Compounds—Special Topics in Heterocyclic Chemistry,* Chapter 18, Paragraph 14, pages 482–515, John Wiley & Sons, New York and London (1977).

As general formulae of cyanine dyes, merocyanine dyes and rhodacyanine dyes, the formulae (XI), (XII) and (XIII) illustrated in U.S. Pat. No. 5,340,694, columns 21 and 22, are suitable respectively. However, the dyes of the invention have no particular restrictions as to n12, n15, n17 and n18 in those formulae. In other words, n12, n15, n17 and n18 each may be an integer of 0 or above in the invention.

The suitable number of methine groups in $Q_1$ is from 0 to 7, preferably from 0 to 5, particularly preferably 3. It is desirable for the methine groups to have substituent groups necessary for forming methine dyes (e.g., heterocyclic, aliphatic or aromatic groups). The suitable substituent groups are heterocyclic or aromatic groups, especially heterocyclic groups. Suitable examples of a heterocyclic group as the substituent group include those described above as examples of $Z_1$ and $Z_2$.

Examples of an aromatic group as the substituent group include substituted or unsubstituted aromatic groups (such as 4-dimethylaminophenyl, 4-methoxyphenyl, phenyl and 4-dimethylaminonaphthyl).

Examples of an aliphatic group preferred as the substituent group include alkoxycarbonyl groups (e.g., ethoxycarbonyl) and acyl groups (e.g., acetyl).

In addition to these groups, as the substituent group, the groups described above as substituent V, such as substituted or unsubstituted amino groups (e.g., amino, dimethylamino), a cyano group and substituted or unsubstituted alkylsulfonyl groups (e.g., methylsulfonyl) are exemplified.

Examples of the compound of formula (I) of the present invention (including also the compound of formula (II) as a lower conception) are illustrated below, but these examples should not be construed as limiting the scope of the invention in any way.

I-1

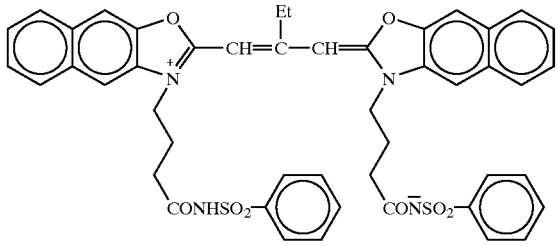

-continued
I-2
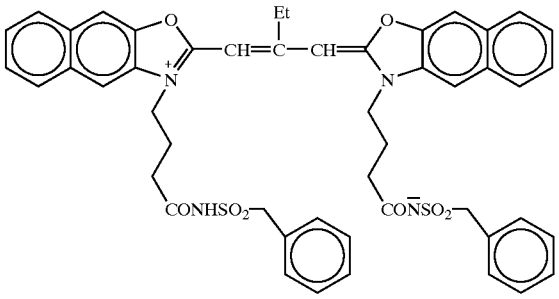
I-3
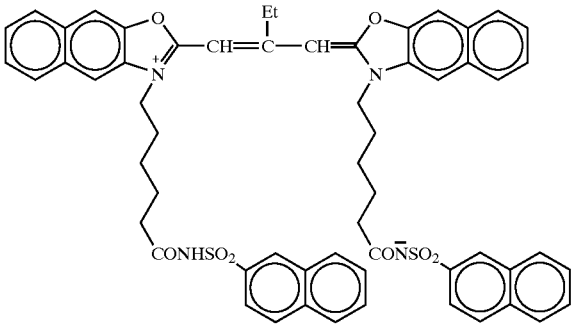
I-4
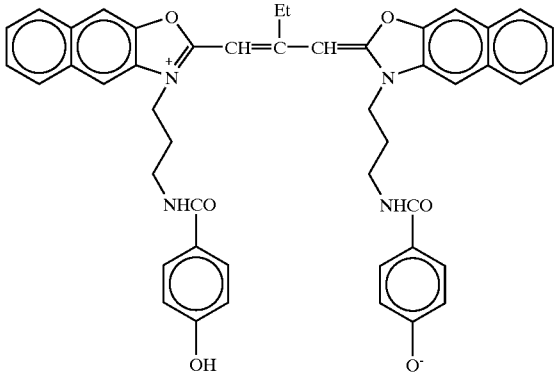
I-5
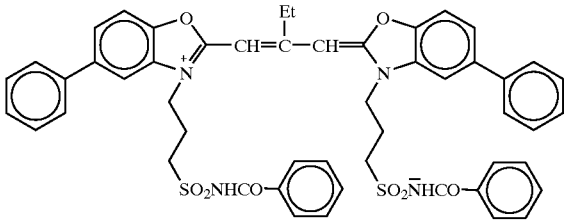
I-6
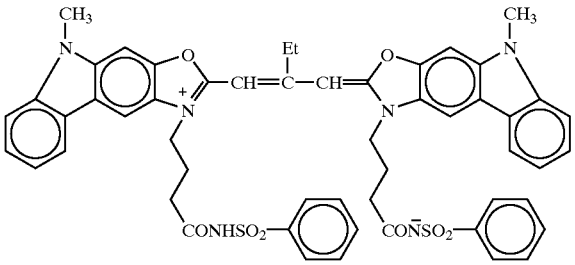
-continued
I-7
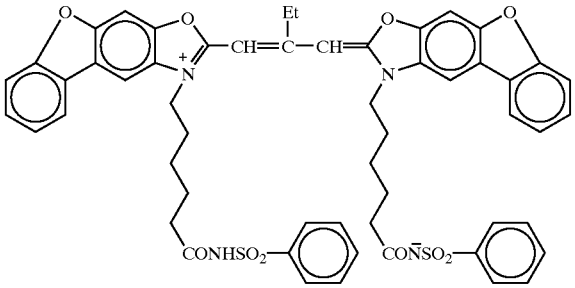
I-8
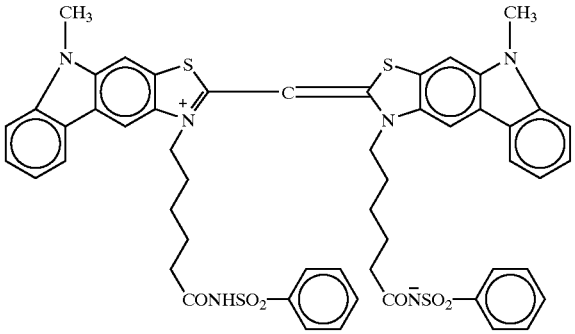
I-9
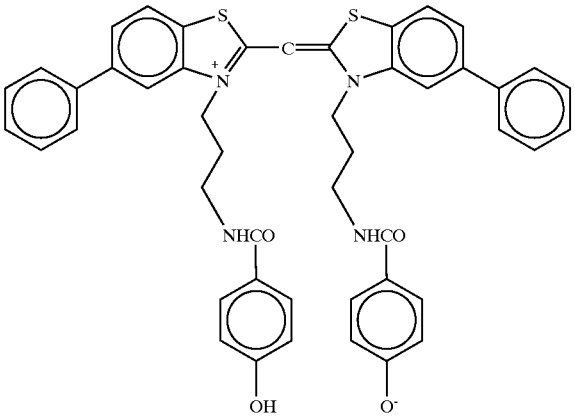
I-10
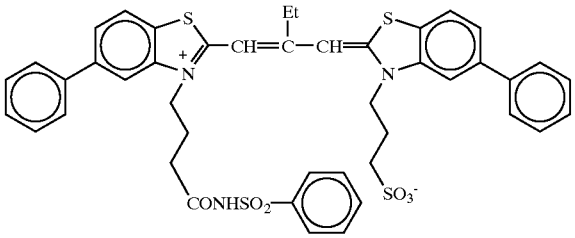

-continued

I-11

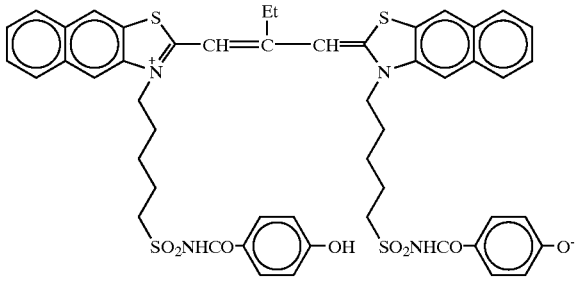

I-12

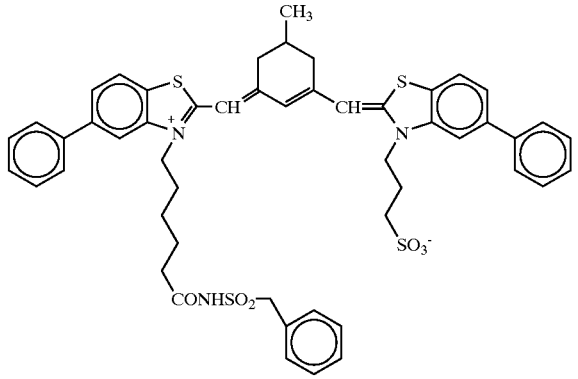

I-13

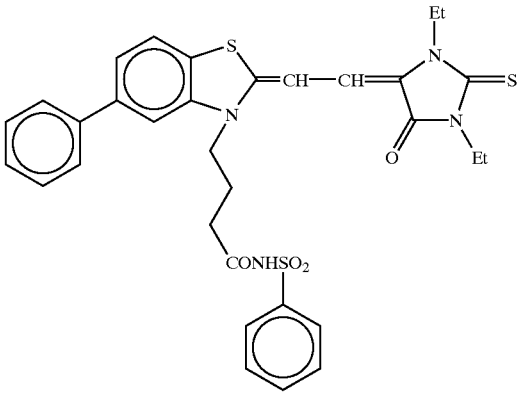

I-14

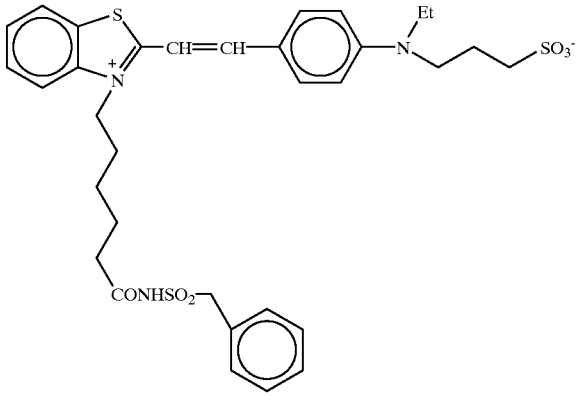

The present compounds represented by formula (I) can be synthesized by referring to the methods as described in, e.g., F. M. Harmer, *Heterocyclic Compounds—Cyanine Dyes and Related Compounds*, John Wiley & Sons, New York and London (1964), D. M. Sturmer, *Heterocyclic Compounds—Special Topics in Heterocyclic Chemistry, Chapter* 18, Paragraph 14, pages 482–515, John Wiley & Sons, New York and London (1977), and *Rodd's Chemistry of Carbon Chemistry*, Second Edition, Volume IV, part B, Chapter 15, pages 369–422, Elsevier Science Publishing company Inc., New York (1977).

In the next place, silver halide photographic emulsions relating to the present invention and silver halide photographic materials according to the present invention are described below in detail.

The term "light absorption intensity" used in the invention refers to the areal intensity of light absorption by sensitizing dyes per unit grain surface area, and defined as the value obtained by integrating the optical density $\mathrm{Log}(I_0/(I_0-I))$ with respect to wave number ($cm^{-1}$) when taking the quantity of light subjected to incidence on the unit surface area of grain as $I_0$ and the quantity of light absorbed by sensitizing dyes present on the unit grain surface as I. The integration range therein is from 5,000 $cm^{-1}$ to 35,000 $cm^{-1}$.

It is desirable for the silver halide photographic emulsion relating to the invention to comprise at least 50% of the projected area of the entire silver halide grains, silver halide grains having a light absorption intensity of at least 100 when the grains have the spectral absorption maximum wavelength of not less than 500 nm or silver halide grains having a light absorption intensity of at least 60 when the grains have the spectral absorption maximum wavelength of less than 500 nm. In the case where the grains have the spectral absorption maximum wavelength of 500 nm or more, the light absorption intensity is preferably at least 150, more preferably at least 170, particularly preferably at least 200; while when the grains have the spectral absorption maximum wavelength of less than 500 nm the light absorption intensity is preferably at least 90, more preferably at least 100, particularly preferably at least 120. The light absorption intensity has no particular upper limit, but the upper limit thereof is preferably 2,000 or less, more preferably 1,000 or less, particularly preferably 500 or less.

As to the grains having their spectral absorption maximum wavelength of less than 500 nm, it is preferable that the spectral absorption maximum wavelength be not less than 350 nm.

As an example of the measurement method of light absorption intensity, a method of using a microspectrophotometer is exemplified. The microspectorphotometer is an apparastus capable of measuring the absorption spectrum of a minute area, and capable of measuring the transmission spectrum of one grain. For the measurement of absorption spectrum of one grain by microspectral method, the report by Yamashita et al (*A collection of abstracts of lectures in* 1996 *Annual Meeting of Japanese Photographic Society*, page 15) can be referred to. The absorption intensity per one grain can be determined from the absorption spectrum of one grain. the light transmitting a grain is absorbed at two phases of the upper and lower phases, of the grain. Accordingly, the absorption intensity per unit area of grain surface can be determined as ½ of the absorption intensity per one grain. The range for integrating the absorption spectrum is, by definition, from 5,000 $cm^{-1}$ to 350,000 $cm^{-1}$, but the range integrating the absorption spectrum may be the range including about 500 $cm^{-1}$ wherein sensitizing dyes have absorption from the experimental point of view.

Without using the microspectral method, the absorption intensity per unit area of grain surface can be determined from the measurement of transmission spectrum of grains arranged so as not to overlap with each other, and besides, so as to leave no gap between them.

Further, the light absorption intensity is a value uniquely determined by the oscillator strength of a sensitizing dye used and the number of the molecules adsorbed per unit area, and so if the oscillator strength of a sensitizing dye used, the quantity of dye adsorbed and the grain surface area are determined respectively, these values can be converted into the light absorption intensity.

The oscillator strength of a sensitizing dye can be determined experimentally as the value proportional to the absorption area intensity by a sensitizing dye solution (optical density×$cm^{-1}$), so that when the absorption area intensity per a 1M solution of sensitizing dye is represented by A (optical density×$cm^{-1}$), the quantity of sensitizing dye adsorbed is represented by B (mole/mole Ag) and the grain surface area is represented by C ($m^2$/mole Ag), the light absorption intensity can be determined by the following formula, with an error of the order of about 10%:

$$0.156 \times A \times B/C$$

In other words, the value of the light absorption intensity calculated from the above formula is practically the same as the value determined by the measurement based on the foregoing definition (i.e., the value obtained by integrating $\log(I_0/(I_0-I))$ with respect to wave number ($cm^{-1}$)).

It is desirable that the present dyes be used in combination with one of the methods described below as suitable methods for realizing the silver halide grains having at the spectral absorption maximum wavelength of less than 500 nm, a light absorption intensity of at least 60 or at the spectral absorption maximum wavelength of 500 nm or more, a light absorption intensity of at least 100.

Examples of such methods include the method of using an aromatic group-containing dye or the combination of an aromatic group-containing cationic dye and an anionic dye as disclosed in JP-A-10-2239789, JP-A-8-269009, JP-A-10-123650 and JP-A-8-328189, the method of using a dye having a polyvalent charge as disclosed in JP-A-10-171058, the method of using a pyridinium group-containing dye as disclosed in JP-A-10-104774, the method of using a hydrophobic group-containing dye as disclosed in JP-A-10-186559, and the method of using a coordination bond group-containing dye as disclosed in JP-A-10-197980.

The particularly suitable way of using the dyes of the present invention consists in using them as the cationic dyes in the methods of using dyes containing least one aromatic group as disclosed in JP-A-10-2239789, JP-A-8-269009, JP-A-10-123650 and JP-A-8-328189. Of these methods, the method of using a positively charged dye alone and the method of using the combination of positively and negatively charged dyes in which at least one of their dyes contains at least one aromatic group as a substituent are preferred. When the present dye compounds are used as cationic dyes in any of the foregoing methods, the effects aimed at by the invention can be achieved. In another way, the present dyes can be used as betaine dyes.

As to the manner in which the dyes of the present invention are added, any manner may be adopted, but the following manner is used to advantage. Specifically, the suitable manner comprises preparing a dye solution by dissolving each of the present dyes in a solvent adjusted to pH higher than pKa in the first or second dissociation of a proton dissociative group contained in the dye, then adding the dye solution to an emulsion previously adjusted to pH higher than the pKa in the first or second dissociation, and further gradually lowering the pH of the resulting emulsion from the level ensuring high solubility for the highly hydrophobic dye to a level lower than the pKa in first or second dissociation of the proton dissociative group.

It is desirable for the dye chromophores to be adsorbed to silver halide grains in a total of at least 1.5 layers, preferably 1.7 layers or more, particularly preferably 2 layers or more. The number of dye chromophore layers has no particular upper limit, but it is preferably 10 layers or below, particularly preferably 5 layers or below.

The expression "state in which chromophores are adsorbed to the silver halide grain surface in more than one layer" as used in the present invention means the state that the quantity of dye chromophores adsorbed per unit area of silver halide grain surface is greater than the one-layer saturation coverage which is defined as the saturated absorption quantity per unit area achieved by the smallest dye of all sensitizing dyes added to the emulsion with respect to the dye occupation area on the silver halide grain surface. In addition, the number of adsorption layers signifies an adsorption quantity expressed on a basis of one-layer saturation coverage. In the case of dyes in which dye chromophores are linked by covalent bonds, dye occupation areas of individual dyes in the unlinked sate are adopted as standards.

The dye occupation area can be determined from the grain surface area and the adsorption isotherm showing a relation between the free dye concentration and the quantity of adsorbed dye. The adsorption isotherm can be determined by reference to, e.g., A. Herz et al., *Adsorption from Aqueous Solution*, Advances in Chemistry Series No. 17, page 173 (1968).

For determination of the quantity of a sensitizing dye adsorbed to emulsion grains, the following two methods can be adopted. In one method, the adsorbed dye quantity is determined by separating a dye-adsorbed emulsion into emulsion grains and a supernatant gelatin solution by means of a centrifuge, determining the unadsorbed dye concentration from the spectrophotometry of the supernatant solution, and subtracting the quantity of unadsorbed dye from the quantity of the dye added. In the other method, the emulsion grains precipitated are dried, a fixed weight of the precipitate is dissolved in a 1:1 mixture of an aqueous sodium thiosulfate solution and methanol, and the spectral absorption thereof is measured, thereby determining the quantity of the adsorbed dye. In the case of using two or more kinds of sensitizing dyes, the adsorption quantities of individual dyes can be determined by, e.g., high-performance liquid chromatography. For determining the dye adsorption quantity by determining the dye content in a supernatant solution, W. West et al., *Journal of Physical Chemistry*, volume 56, page 1054 (1952) can be referred to. However, under the condition that dyes are added in large amounts even the unadsorbed dyes tend to settle, so that the method utilizing the determination of a dye concentration in the supernatant solution cannot always give a correct adsorption quantity. On the other hand, the method of determining the dye adsorption quantity through the dissolution of precipitated silver halide grains can determine correctly the quantity of only dyes adsorbed to grains since the emulsion grains can be easily separated from the precipitated dyes because of their overwelmingly high sedimentation speed. This method can be considered as the most reliable method for determining the dye adsorption quantity.

As an example of the method for determining the surface area of silver halide grains, there is known a method of taking transmission electron micrographs of silver halide grains by the use of replication and calculating the surface areas of individual grains from the grain shapes and sizes determined by the electron micrographs. According to this method, the thickness of tabular grains is calculated from the length of replica shadow. For the method of taking transmission electron micrographs, books such as *Densi Kenbikyo Shiryo Gijutu-shu* (which means "Collection of specimen preparation techniques for electron microscope"), compiled by the Kanto branch of Nippon Denshi Kenbikyo Gakkai, published by Seibundo Shinkosha (1970), and P. B. Hirsch et al., *Electron Microscopy of thin Crystals*, Butterworths Co., London (1965) can be referred to.

For other usable methods, various books, e.g., A. M. Kragin et al., *The Journal of Photographic Science*, vol. 14, p. 185 (1966), J. F. Paddy. *Transactions of the Faraday Society*, vol. 60, p. 1325 (1964), S. Boyer et al., *Journal de Chimie Physique et de Physicochimie Biologique*, vol. 63, p. 1123 (1963), W. West et al., Journal of Physical Chemistry, vol. 56, p. 1054 (1952), and H. Sauvenier, E. Klein et al., International Colloquium, Liege, 1959, Scientific Photography, can be referred to.

In each case, the dye occupation area can be determined experimentally by the methods described above. However, the molecular occupation area of generally used sensitizing dyes is around 80 $Å^2$, and so the number of adsorption layers can be roughly estimated by simply assuming that every dye has the dye occupation area of 80 $Å^2$.

When dye chromophores are adsorbed to silver halide grains in multi-layers, the invention has no particular restrictions as to the reduction and oxidation potentials of the dye chromophore directly adsorbed to silver halide grains, namely the first-layer dye chromophore, as well as those of dye chromophores constituting the second layer or above. However, it is advantageous that the reduction potential of the first-layer dye chromophore is more positive than the value obtained by subtracting 0.2 V from the reduction potential of the second or above layer.

For measurements of reduction and oxidation potentials, though various methods can be adopted, phase-discrimination second harmonic alternating-current polarography is employed to advantage because accurate values can be determined thereby. Additionally, the method of measuring potentials by phase-discrimination second harmonic alternating-current polarography is described in Journal of Imaging Science, vol. 30, p. 27 (1986).

The dye chromophores constituting the second layer or above are preferably luminescent dyes. The suitable luminescent dyes are dyes of the kind which have the same skeleton structures (i.e., basic structures) as dyes used for dye laser. These are sorted through in, e.g., in Mitsuo Maeda, *Laser Kenkyu* (Laser studies), vol. 8, pp. 649, 803 and 958 (1980), supra, vol. 9, p. 85 (1981), and F. Sehaefer, *Dye Lasers*, Springer (1973).

Further, it is advantageous that the wavelength at which the dye chromophore constituting the first layer exhibits its absorption maximum in a silver halide photographic material is longer than those at which the dye chromophores constituting the second layer or above exhibit their absorption maxima. Furthermore, it is preferable that the luminescence of the dye chromophores constituting the second layer or above overlaps with the absorption of the dye chromophore constituting the first layer. In addition, it is favorable that the dye chromophore of the first layer takes the form of J-aggregate. Moreover, for effecting absorption and spectral sensitivity in the desired wavelength region, it is advantageous that the dye chromophores of the second layer and above take the form of J-aggregates.

In a silver halide photosensitive material, the methine compounds represented by formula (I) or (II) according to the invention can be used alone or in combination with other sensitizing dyes.

The time for addition of the present methine compounds to a silver halide emulsion may be any of the stages in the emulsion making process so far as usefulness of the addition at those stages has so far been admitted. More specifically, the present methine compounds may be added in the stage of forming silver halide grains or/and before desalting, or in the stage of desalting and/or during the period between the end of desalting and the beginning of chemical ripening, as disclosed in U.S. Pat. Nos. 2,735,766, 3,628,960, 4,183,756 and 4,225,666, JP-A-58-184142 and JP-A-60-196749; while, as disclosed in JP-A-58-113920, the present methine compounds may be added just before or in the stage of chemical ripening, or at any time or stage during the period from after chemical ripening to before emulsion coating. On the other hand, as disclosed in U.S. Pat. No. 4,225,666 and JP-A-58-7629, one compound alone or plural compounds different in structure may be divided, and then added, and for example, added during separate periods, such as in the stage of grain formation and in the stage or after the end of chemical sensitization, or before or in the stage of chemical ripening and after the end of chemical ripening. In such a divided addition, kinds of compounds added in separate stages may be different each other.

In the present invention, it is advantageous to add metal ions, particularly transition metal ions, after grain formation, preferably dye addition. Examples of such metal ions include copper(II) ion, cobalt(II) ion, zinc(II) ion, nickel(II) ion, chromium(III) ion, iron(III) ion, calcium(II) ion, ruthenium ions, rhodium ions, palladium ions, silver ion, platinum ion, gold ion, iridium ion, lanthanoid ions and actinoid ions. Of these ions, transition metal ions, such as copper(II) ion, cobalt(II) ion, zinc(II) ion, nickel(II) ion, chromium(III) ion, iron(III) ion, ruthenium ions, rhodium ions, palladium ions, platinum ion, iridium ion, lanthanoid ions and actinoid ions, are preferred over the others. In particular, the addition of transition metal ions including copper (II) ion, cobalt(II) ion, nickel(II) ion and iron(III) ion is effective. For addition of those ions to emulsions, the metal salts thereof may be used as they are, or after they are dissolved in solvents, such as water. Preferably, the metal salts are added as aqueous solutions. The counter anions of those metal salts may be any of counter anions, but they are preferably counter ions having relatively weak coordination power, such as perchlorate and nitrate ions.

The suitable amount of metal ions added is from about 1/10 to about 10 times in mole terms the amount of compound represented by formula (I). Not only addition of dyes but also addition of metal ions may be carried out in any stage of emulsion-making process. Further, the metal ions may be added after dyes are added in the whole amount, or the metal ions after dyes are added in a partial amount may be added, and then the remaining amount of the dyes may be added, or dyes after addition of the metal ions may be added. In addition, the metal ions previously mixed with dyes may be added to emulsions.

The amount of the present methine dyes and/or other sensitizing dyes depends on the shape and size of silver halide grains, but it can be in the range of $1\times10^{-8}$ to $8\times10^{-3}$ mole per mole of silver halide. When the grains size is from 0.2 to 1.3 $\mu$m, for instance, the suitable addition amount of those dyes is from $2\times10^{-6}$ to $3.5\times10^{-2}$ mole, preferably $7.5\times10^{-6}$ to $1.5\times10^{-2}$ mole, per mole of silver halide.

The present methine compounds (and other sensitizing dyes also) may be dispersed directly into emulsions. In the other way, these compounds may be dissolved in an appropriate solvent, such as methyl alcohol, ethyl alcohol, methyl cellosolve, acetone, water, pyridine or a mixture of two or more of these solvents, and then added to emulsions. In adding the methine compounds to emulsions, additives, such as a base, an acid and a surfactant, may be coexisted. In addition, ultrasonic waves can be used for the dissolution. As examples of other methods usable for adding the present methine compounds, mention may be made of the method of dissolving compounds in a volatile organic solvent, dispersing the solution into a hydrophilic colloid and then adding the dispersion into an emulsion, as disclosed in U.S. Pat. No. 3,469,987; the method of dispersing compounds in a water-soluble solvent and then adding the dispersion to an emulsion, as disclosed in JP-B-46-24185 (the term "JP-B" as used herein means an "examined Japanese patent publication"); the method of dissolving methine compounds in a surfactant and then adding the solution to an emulsion, as disclosed in U.S. Pat. No. 3,822,135; the method of dissolving compounds with the aid of a red shift compound and then adding the solution to an emulsion, as disclosed in JP-A-51-74624; and the method of dissolving methine compounds in a substantially water-free acid and then adding the solution to an emulsion, as disclosed in JP-A-50-80826. In addition to those methods, the methods disclosed in U.S. Pat. Nos. 2,912,343, 3,342,605, 2,996,287 and 3,429,835 can also be adopted for the addition of the present methine dyes to emulsions.

Further, the present methine compounds can also be used as filter dyes, irradiation inhibitive dyes or antihalation dyes for the purpose of improving the sharpness and the color resolution.

In this case, the methine compounds can be incorporated in coating solutions for constituent layers of a silver halide photographic material, such as a filter layer and an antihalation layer. These dyes may be used in an amount enough to color a photographic layer, and persons skilled in the art can properly determine such an amount depending on the end use purpose of use. In general, it is effective to use the dyes in an amount to provide an optical density of 0.05 to 3.0.

The dye addition may be carried out in any stage before coating.

Further, polymers having charges opposite to those of dye ions may be contained as a mordant in the layers containing the dye ions. By interaction between such polymer and dye molecules, the dyes can be localized to a specified layer.

Examples of such a polymeric mordant include the polymers disclosed in U.S. Pat. Nos. 2,548,564, 4,124,386, 3,625,694, 3,958,995, 4,168,976 and 3,445,231.

Examples of supersensitizers useful in the spectral sensitization of the invention include the pyrimidylamino compounds, the triazinylamino compounds and the azolium compounds disclosed in U.S. Pat. Nos 3,511,664, 3,615,613, 3,615,632, 3,615,641, 4,596,767, 4,945,038, 4,965,182 and 4,965,182. In using these supersensitizers, the methods disclosed in the references described above can be used to advantage.

The meanings of the terms used in the invention are explained below.

Dye occupation area: Area occupied by one molecule of dye. This area can be determined experimentally from adsorption isotherm. In the case of dyes in which dye chromophores are linked by covalent bonds, occupation areas of individual dyes in the unlinked sate are adopted as standards. Rough estimation thereof is 80 $Å^2$.

One-layer saturation coverage: Quantity of adsorbed dye per unit grain surface area in the case of one-layer saturation covering, or the reciprocal of the area occupied by the smallest dye of all sensitizing dyes added to the emulsion.

Adsorption in more than one layer (i.e. multi-layer adsorption): State that the quantity of dye chromophores adsorbed per unit area of silver halide grain surface is greater than the one-layer saturation coverage.

Adsorption layer number: Quantity of adsorbed dye chromophores per unit grain surface area, expressed on a basis of one-layer saturation coverage.

In the photographic emulsion comprising silver halide grains having a light absorption intensity of at least 100, the suitable wavelength interval between the shortest wavelength and the longest wavelength showing 50% of the maximum of spectral absorptance attributed to sensitizing dyes adsorbed to the grains, Amax, and that showing 50% of the maximum of spectral sensitivity attributed to the sensitizing dyes, Smax, are each 120 nm or below.

Further, the wavelength interval between the shortest wavelength and the longest wavelength showing 80% of Amax and that showing 80% of Smax are each at least 20 nm, and desirably 100 nm or less, more desirably 80 nm or less, especially desirably 50 nm or less.

Furthermore, the suitable wavelength interval between the shortest wavelength and the longest wavelength showing to 20% of Amax and that showing 20% of Smax are each 180 nm or less, preferably 150 nm or less, more preferably 120 nm or less, particularly preferably 100 nm or less.

The silver halide grains showing their spectral absorption maximum at a wavelength shorter than 500 nm and having a light absorption intensity of at least 60 or those showing their spectral absorption maximum at a wavelength of no shorter than 500 nm and having a light absorption intensity of at least 100 can be realized using the preferable methods as mentioned above. However, dyes constituting the second layer and above are generally adsorbed in a monomer state, and so their absorption peaks and the spectral sensitivities conferred thereby have wider widths than the desired ones in most cases. For realizing high sensitivities in the desired wavelength region, therefore, it is desirable that the dyes constituting the second layer and above be adsorbed in the state of J aggregates.

The expression "dyes constituting the second layer and above" as used in the invention refers to dyes which are indeed adsorbed to silver halide grains, but not directly.

The state of J aggregates formed by dyes constituting the second layer and above in the invention is defined as a state that the longer wavelength-side width of the absorption by the dyes adsorbed to the second layer or above is not more than twice the longer wavelength-side width of the absorption by the solution of dyes in a monomer state wherein the interaction between the dye chromophores is absent. Herein, the longer wavelength-side width of absorption is represented by an energy width between the absorption maximum wavelength and the wavelength showing the absorption equal to one-half the absorption maximum and being located on the longer wavelength side. It is known that the absorption width on the longer wavelength side is generally narrow in a J-aggregated state, as compared with a monomer state. When the dye adsorbed to the second layer is in a monomer state, the longer wavelength-side width of the absorption by such a dye becomes at least twice that by the solution of dye in a monomer state because of non-uniformity of adsorption site and state. Accordingly, the J aggregates of dyes adsorbed to the second layer and above can be described by the foregoing definition.

The spectral absorption of dyes adsorbed to the second layer or above can be determined by subtracting the spectral absorption by the first-layer dye from the spectral absorption by the total emulsion.

The spectral absorption by the first-layer dye is determined by measurement of the absorption spectrum of an emulsion to which only the first-layer dye is added. On the other hand, the dyes constituting the second layer or above can be removed from emulsion grains to which dyes are adsorbed in a multilayer by the addition of a dye desorption agent, and thereby it becomes possible to measure the spectral absorption spectrum of the first-layer dye left on the emulsion grains.

In the experiment to desorb dyes from emulsion grain surface by the use of a dye desorption agent, the dye constituting the first layer is generally desorbed after the dyes constituting the second layer or above are desorbed. Therefore, if the desorption condition is chosen properly, the spectral absorption by the first-layer dye can be determined. As a result, it becomes possible to determine spectral absorption by dyes constituting the second layer and above. For details of the method of using a dye desorption agent, the reports by Asanuma et al. in Journal of Physical Chemistry B, vol. 101, pp. 2149–2153 (1997) can be referred to.

In the present invention, dyes other than the dyes represented by formula (I) or (II) may be added, but it is advantageous to add the dyes represented by formula (I) or (II) in a proportion of at least 50 mol %, preferably at least 70 mol %, particularly preferably at least 90 mol %, to the total dyes added.

By adding dyes in such a way, the dye molecules constituting the second layer or above can enhance their mutual interaction, promoting their rearrangement, and thereby the formation of J aggregates can be realized.

When the dyes of formula (I) or (II) are used as the first-layer dye, it is advantageous for $Z_1$, and $Z_2$ each to complete a basic nucleus substituted by an aromatic group or a basic nucleus condensed with three or more rings. When they are used as the second-layer dye, on the other hand, it is preferable that $Z_1$ and $Z_2$ each complete a basic nucleus condensed three or more rings.

The number of condensed rings present in a basic nucleus is, e.g., 2 in the case of benzoxazole nucleus or 3 in the case of naphthoxazole nucleus. And it is also 2 in the case of a phenyl-substituted benzoxazole nucleus. The basic nucleus having at least 3 condensed rings may be any of the polycyclic condensed type heterocyclic basic nuclei wherein at least three rings are condensed, but it is preferably a heterocyclic ring of tricyclic or tetracyclic condensed type.

Suitable examples of a heterocyclic ring of tricyclic condensed type include naphoto[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, naphtho[2,3-d]imidazole, naphtho[1,2-d]imidazole, naphtho[2,1-d]imidazole, naphoto [2,3-d]selenazole, naphtho [1,2-d]selenazole, naphtho[2,1-d]selenazole, indolo[5,6-d]oxazole, indolo[6,5-d]oxazole, indolo[2,3-d]oxazole, indolo[5,6-d]thiazole, indolo[6,5-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[6,5-d]thiazole, benzofuro[2,3-d]thiazole, benzothieno[5,6-d]oxazole, benzothieno[6,5-d]oxazole and benzothieno[2,3-d]oxazole. Suitable examples of a heterocyclic ring of tetracyclic condensed type include anthra[2,3-d]oxazole, anthra[1,2-d]oxazole, anthra[2,1-d]oxazole, anthra[2,3-d]thiazole, anthra[1,2-d]thiazole, phenanthro[2,1-d]thiazole, phenanthro[2,3-d]imidazole, anthra[1,2-d]imidazole, anthra[2,1-d]imidazole, anthra[2,3-d]selenazole, phenathro[1,2-d]selenazole, phenanthro[2,1-d]selenazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, benzofuro[5,6-d]oxazole, dibenzothieno[2,3-d]oxazole, dibenzothieno[3,2-d]oxazole, tetrahydrocarbazolo[6,7-d]oxazole, tetrahydrocarbazolo[7,6-d]oxazole, dibenzothieno[2,3-d]thiazole, dibenzothieno[3,2-d]thiazole and tetrahydrocarbazolo[6,7-d]thiazole. More suitable examples of a basic nuclei having 3 or more condensed rings include naphoto[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, indolo[5,6-d]oxazole, indolo[6,5-d]oxazole, indolo[2,3-d]oxazole, indolo[5,6-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[2,3-d]thiazole, benzothieno[5,6-d]oxazole, anthra[2,3-d]oxazole, anthra[1,2-d]oxazole, anthra[2,3-d]thiazole, anthra[1,2-d]thiazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole.

Of these basic nuclei, particularly preferred heterocyclic rings are naphoto[2,3-d]oxazole, naphtho[1,2-d]oxazole, naphtho[2,3-d]thiazole, indolo[5,6-d]oxazole, indolo[6,5-d]oxazole, indolo[5,6-d]thiazole, benzofuro[5,6-d]oxazole, benzofuro[5,6-d]thiazole, benzofuro[2,3-d]thiazole, benzothieno[5,6-d]oxazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole.

As silver halides in a photographic emulsion taking in charge of sensitive mechanism, any of silver bromide, silver iodobromide, silver chlorobromide, silver iodide, silver iodochloride, silver iodobromochloride and silver chloride may be used in the present invention. However, emulsion grains having at their outermost surface a halide composition comprising iodide in a proportion of at least 0.1 mole %, preferably at least 1 mole %, particularly preferably at least 5 mole %, are favorable for forming a stronger multilayer adsorption structure.

The distribution of grain sizes may be either broad or narrow, but it is preferable for the grains to have a narrow size distribution.

The silver halide grains of a photographic emulsion may have any of crystal shapes, including regular crystal shapes such as a cube, an octahedron, a tetradecahedron and an orthorhombic dodecahedron and irregular crystal shapes such as a sphere and a tablet, crystal shapes having a ((hkl) plane, or a mixture of two or more of these crystal shapes. However, the use of tabular grains is preferred in the invention. The details of tabular grains are described below. The grains having a (hkl) plane are described in *Journal of Imaging Science*, vol. 30, pp. 247–254 (1986) can be referred to.

The silver halide grains described above may be contained alone or as a mixture of two or more thereof in the silver halide photographic emulsions used in the invention. The silver halide grains used may have different phase between the interior and the surface layer thereof, or they may have a multi-phase structure having conjugation structure, or they may have a local phases on the grain surface, or they may comprise uniform phase. In addition, the silver halide grains may also comprise mixtures of these phases.

These various emulsions may be a surface latent image type which mainly forms latent images on the grain surfaces, or an internal latent image type which mainly forms latent images inside the grains.

The silver halide emulsion grains used preferably in the present invention are tabular silver halide grains having a higher surface area/volume ratio to which the methine compounds disclosed in the invention are adsorbed as sensitizing dyes. The suitable aspect ratio of such tabular grains is from 2 to 100, preferably from 5 to 80, particularly preferably from 8 to 80, and the suitable thickness thereof is less than 0.2 μm, preferably less than 0.1 μm, particularly preferably less than 0.07 μm.

For the preparation of tabular grains having such a high aspect ratio and a small thickness as mentioned above, the following techniques can be applied.

The suitable halide composition of tabular silver halide grains used in the invention is chloride, bromide, chlorobromide, iodobromide, chloroiodobromide or iodochloride. It is desirable for the tabular grains to have (100) or (111) faces as the main planes. The tabular grains having (111) main planes are referred to as (111) tabular grains hereinafter. The (111) tabular grains generally have triangular or hexagonal planes. In general, the proportion of grains having hexagonal planes becomes higher the more uniform the grains are in size distribution. The details of monodisperse hexagonal tabular grains are described in JP-B-5-61205.

The tabular grains having (100) faces as the main planes, hereinafter referred to as (100) tabular grains, have a rectangular or square form. As to these emulsion grains, grains having adjacent side ratio of less than 5/1, not acicular grains are called tabular grains. When the halide composition of tabular grains is chloride or rich in chloride, the (100) tabular grains essentially have higher main plane stability than the (111) tabular grains. In the case of (111) tabular grains, it is required to stabilize the (111) main planes. The methods for stabilizing these planes are disclosed in JP-A-9-80660, JP-A-9-80656 and U.S. Pat. No. 5,298,388.

The (111) tabular silver chloride grains and the (111) tabular silver halide grains having high chloride contents, which can be used to advantage, are disclosed, e.g., in U.S. Pat. Nos. 4,414,306, 4,400,463, 4,713,323, 4,783,398, 4,962,491, 4,983,508, 4,804,621, 5,389,509, 5,217,858 and 5,460,934.

The (111) silver halide tabular grains having high bromide contents, which are usable in the invention, are disclosed, e.g., in U.S. Pat. Nos. 4,425,425, 4,425,426, 4,434,266, 4,439,520, 4,414,310, 4,433,048, 4,647,528, 4,665,012, 4,672,027, 4,678,745, 4,684,607, 4,593,964, 4,722,886, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

The (100) tabular grains usable in the invention are disclosed, e.g., in U.S. Pat. Nos. 4,386,156, 5,275,930, 5,292,632, 5,314,798, 5,320,938, 5,319,635 and 5,356,764, European Patents 569971 and 737887, JP-A-6-308648 and JP-A-9-5911.

In general silver halide emulsions are used after undergoing chemical sensitization. Chemical sensitization can be effected using a chalcogen sensitization (e.g., a sulfur, selenium or tellurium sensitization), a sensitization utilizing a noble metal compound (e.g., a gold sensitization) and a reduction sensitization, either individually or in combination of two or more thereof.

In the invention, silver halide emulsions sensitized with at least selenium compounds are used to advantage. More specifically, it is effective to subject silver halide emulsions to selenium sensitization alone, or a combination of selenium sensitization and another chalcogen sensitization and/or noble metal sensitization (especially gold sensitization). In particular, the combined use of selenium sensitization and noble metal sensitization is beneficial.

In selenium sensitization, labile selenium compounds are used as sensitizers. Descriptions of labile selenium compounds can be found in JP-B-43-13489, JP-B-44-15748, JP-A-4-25832, JP-A-4-109240, JP-A-4-271341 and JP-A-5-40324. Examples of a selenium sensitizer include colloidal metallic selenium, selenoureas (such as N,N-dimethylselenourea, trifluoromethylcarbonyltrimethylselenourea and acetyltrimethylselenourea), selenoamides (such as selenoacetamide and N,N-diethylphenylselenoamide), phosphine selenides (such as triphenylphosphine selenide and pentafluorophenyltriphenylphosphine selenide), selenophosphates (such as tri-p-tolylselenophosphate and tri-n-butylselenophosphate), selenoketones (such as selenobenzophenone), isoselenocyanates, selenocarboxylic acids, selenoesters and diacylselenides. Additionally, comparatively stable selenium compounds such as selenious acid, potassium selenocyanide, selenazoles and selenides (as disclosed in JP-B-46-4553 and JP-B-52-34492) can be used as selenium sensitizers.

In sulfur sensitization, labile sulfur compounds are used as sensitizers. Descriptions of labile sulfur compounds can be found, e.g., in P. Glafkides, *Chemie et Physique Photographique,* 5th edition, Paul Montel (1987), and *Research Disclosure*, vol. 307, No. 307105. Examples of a sulfur sensitizer include thiosulfates (such as hypo), thioureas (such as diphenylthiourea, triethylthiourea, N-ethyl-N'-(4-methyl-2-thiazolyl)thiourea and carboxymethyltrimethylthiourea), thioamides (such as thioacetamide), rhodanines (such as diethylrhodanine and 5-benzylidene-N-ethyl-rhodanine), phosphine sulfides (such as trimethylphosphine sulfide), thiohydantoins, 4-oxo-oxazolidine-2-thiones, polysulfides (such as dimorpholine disulfide, cystine and hexathiocane-thione), mercapto compounds (such as cysteine), polythionates and elemental sulfur. Active gelatin also can be used as a sulfur sensitizer.

In tellurium sensitization, labile tellurium compounds are used as sensitizers. Descriptions of labile tellurium compounds can be found, e.g., in Canadian Patent 800,958, British Patents 1,295,462 and 1,396,696, JP-A-4-204640, JP-A-4-271341, JP-A-4-333043 and JP-A-5-303157. Examples of a tellurium sensitizer include telluroureas (such as tetramethyltellurourea, N,N-dimethylethylenetellurourea and N,N'-diphenylethylenetellurourea), phosphine tellurides (such as butyldiisopropylphosphine telluride, tributylphosphine telluride, tributoxyphosphine telluride and ethoxydiphenylphosphine telluride), diacyl(di)tellurides (such as bis(diphenylcarbamoyl)ditelluride, bis(N-phenyl-N-methylcarbamoyl)ditelluride, bis(N-phenyl-N-methylcarbamoyl)telluride and bis(ethoxycarbonyl)telluride), isotellurocyanates, telluroamides, tellurohydrazides, telluro esters (such as butylhexyltelluro ester), telluro ketones (such as telluroacetophenone), colloidal tellurium, (di) tellurides and other tellurium compounds (such as potassium telluride and sodium telluropentathionate).

In noble metal sensitization processes, the salts of noble metals, such as gold, platinum, palladium and iridium, are used as sensitizers. Descriptions of noble metal salts can be found, e.g., in P. Glafkides, *Chemie et Physique Photographique,* 5th edition, Paul Montel (1987), and *Research Disclosure,* vol. 307, No. 307105. Gold sensitization is preferred in particular. As described above, the present invention can be especially effective in gold sensitization-introduced modes.

Possibilities of eliminating gold from the sensitizing nuclei on emulsion grains by the use of a solution containing potassium cyanide are described in Photographic Science and Engineering, vol. 19322 (1975) and Journal of Imaging Science, vol. 3228 (1988). According to those descriptions, cyanide ions enable the gold atoms or gold ions adsorbed to silver halide grains to be liberated therefrom through the formation of cyano complex, resulting in hindering gold sensitization. Therefore, gold sensitization effect can be fully achieved as far as the generation of cyanogen is controlled according to the invention.

Examples of a gold sensitizer include chloroauric acid, potassium chloroaurate, potassium aurithiocyanate, gold sulfide and gold selenide, as well as the gold compounds disclosed in U.S. Pat. Nos. 2,642,361, 5,049,484 and 5,049,485.

In reduction sensitization, reducing compounds are used as sensitizers. Descriptions of reducing compounds can be found, e.g., in P. Glafkides, *Chemie et Physique Photographique,* 5th edition, Paul Montel (1987), and *Research Disclosure,* vol. 307, No. 307105. Examples of a reduction sensitizer include aminoiminomethanesulfinic acid (thiourea dioxide), borane compounds (such as dimethylamineborane), hydrazine compounds (such as hydrazine and p-tolylhydrazine), polyamine compounds (such as diethylenetriamine and triethylenetetramine), stannous chloride, silane compounds, reductones (such as ascorbic acid), sulfites, aldehyde compounds and hydrogen gas. In addition, reduction sensitization can also be effected in the atmosphere of high pH or excess silver ions (the so-called silver ripening). The reduction sensitization is preferably carried out at the time of grain formation.

The amount of sensitizers used is determined depending on the kind of silver halide grains and the condition of chemical sensistization.

The amount of chalcogen sensitizers used is generally from $10^{-8}$ to $10^{-2}$ mole, preferably from $10^{-7}$ to $5\times10^{-3}$ mole, per mole of silver halide.

The amount of noble metal sensitizers used is from $10^{-7}$ to $10^{-2}$ mole per mole of silver halide.

The present invention has no particular restrictions as to conditions for chemical sensitization. However, the pAg of emulsions under chemical sensitization is generally from 6 to 11, preferably from 7 to 10, and the pH thereof is preferably from 4 to 10. The suitable temperature under which the chemical sensitization is carried out is from 40° C. to 95° C., preferably from 45° C. to 85° C.

For details of various additives for silver halide emulsions (e.g., binders, chemical sensitizers, spectral sensitizers, stabilizers, gelatins, hardeners, surfactants, antistatic agents, polymer latices, matting agents, color couplers, ultraviolet absorbents, discoloration inhibitors, dyes) , and supports and processing methods for photographic materials (including coating methods, exposure methods and development-processing methods), the descriptions in *Research disclosure,* vol. 176, No. 17643 (RD-17643), ibid. vol. 187, No. 18716 (RD-18716) and ibid. vol. 225, No. 22534 (RD-22534) can be referred to. The locations where the additives are described in each of those references are listed below.

| Kinds of Additives | | RD-17643 | RD-18716 | RD-22534 |
|---|---|---|---|---|
| 1. | Chemical sensitizer | p.23 | p. 648, right column | p.24 |
| 2. | Sensitivity increasing agent | | p. 648, right column | |
| 3. | Spectral sensitizer and Supersensitizer | pp. 23–24 | p. 648, right column, to p. 649, right column | pp. 24–28 |
| 4. | Brightening agent | p. 24 | | |
| 5. | Antifoggant and Stabilizer | pp. 24–25 | p. 649, right column | p. 24 and p. 31 |
| 6. | Light absorbent, Filter dye, UV Absorbent | pp. 25–26 | p. 649, right column, to p. 650, left column | |
| 7. | Stain inhibitor | p. 25, right column | p. 650, left to right column | |
| 8. | Dye image stabilizer | p. 25 | | p. 32 |
| 9. | Hardener | p. 26 | p. 651, left column | p. 32 |
| 10. | Binder | p. 26 | p. 651, left column | p. 28 |
| 11. | Plasticizer, Lubricant | p. 27 | p. 650, right column | |
| 12. | Coating aid, Surfactant | pp. 26–27 | p. 650, right column | |
| 13. | Antistatic agent | p. 27 | p. 650, right column | |
| 14. | Color coupler | p. 25 | p. 649 | p. 31 |

In preparing photographic emulsions used in the invention, the methods disclosed in JP-A-10-239789, column 63, line 36, to column 65, line 2, can be adopted.

As additives, including color couplers, in photographic materials, kinds of photographic materials to which the invention is applicable and processing methods therefor, those disclosed in JP-A-10-239789, column 65, line 3, to column 73, line 13, can be utilized, too.

EXAMPLE

The present invention will now be illustrated in greater detail by reference to the following examples, but it should be understood that these examples are not to be construed as limiting the scope of the invention in any way.

Example 1

Synthesis of Compound (I-1)

Compound (I-1) of the present invention was synthesized according to the following reaction scheme 1.

Reaction Scheme 1:

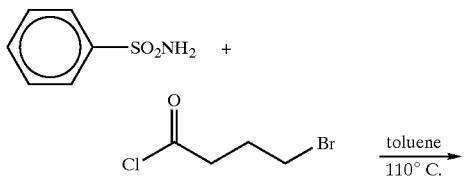

-continued

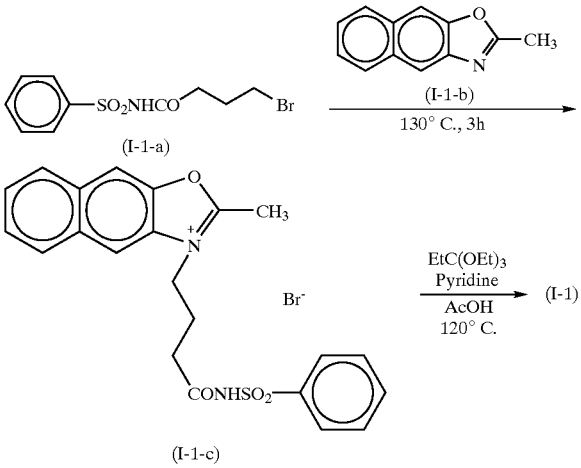

Synthesis of Compound (I-1-a)

A solution containing 23.3 g of 3-bromobutyric acid chloride in 100 ml of toluene was gradually added dropwise to 20 g of benzenesulfonamide. Thereafter, the stirring was continued for 30 minutes at room temperature. Then, the bath temperature was raised to 110° C., and the reaction mixture was stirred for 3 hours at 110° C. as nitrogen gas was bubbled therethrough. The resulting solution was supplemented with 50 ml of toluene, and allowed to stand till the temperature thereof dropped to room temperature. The crystals precipitated were filtered off, washed with hexane, and then dried under reduced pressure to give 33.3 g of Compound (I-1-a) (in a 86% yield).

Synthesis of Compound (I-1-c)

Compound (I-1-a) in an amount of 3.6 g was mixed with 2.0 g of 2-methyl-γ-naphthoxazole (I-1-b), and stirred for 3 hours at 130° C. The reaction mixture thus obtained was allowed to stand till the temperature thereof dropped to room temperature, and then mixed with 100 ml of ethyl acetate, followed by 2-hour stirring at room temperature. The crystals thus precipitated were filtered off, washed with ethyl acetate, and then dried under reduced pressure to give 2.50 g of Compound (I-1-c) (in a yield of 46%).

Synthesis of Compound (I-1)

Compound (I-1-c) in an amount of 2.5 g was mixed with 3.0 ml of triethyl orthopropionate, 6.0 ml of pyridine and 2.5 ml of acetic acid, and stirred for 1 hour as the bath temperature was kept at 120° C. After cooling, the reaction mixture obtained was admixed with 100 ml of ethyl acetate and 50 ml of hexane to separate into two layers. The viscous liquid layer thus separated was recovered by decantation, and further washed twice in the same manner. After draining off the ethyl acetate and the hexane, the viscous liquid was admixed with 20 ml of methanol to deposit crystals. These crystals were filtered off, and then dissolved again by the addition of methanol and 1 ml of triethylamine with stirring. The filtration of the resulting solution was carried out for dust removal, and the filtrate was concentrated by evaporating the methanol to about 30 ml under reduced pressure. At this point, crystals was deposited. Thereto, 1 ml of acetic acid was further added and cooled in order to complete the separation. These crystals were filtered off, washed with methanol, and then dried under reduced pressure. Thus, 0.44 g of Compound (I-1) was obtained in a yield of 17%. The absorption maximum λmax and extinction coefficient ε of this compound in a methanol (absorption) solution was 515.5 nm and $1.82\times10^5$ respectively, and pKal of this compound was 6.47 and pKa2 thereof was 10.10.

Example 2

Synthesis of Compound (I-2)1

Compound (I-2) of the present invention was synthesized according to the following reaction scheme 2.

Reaction Scheme 2:

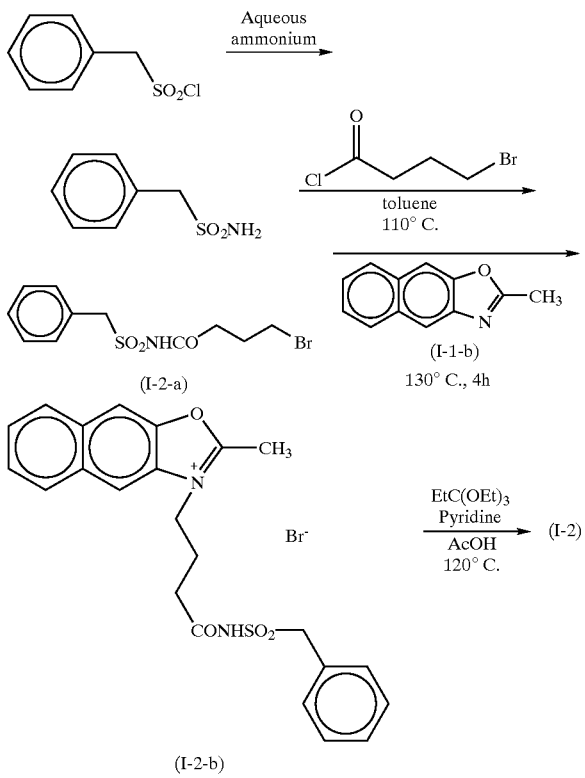

Synthesis of Compound (I-2-a)

A solution containing 16.1 g of 3-bromobutyric acid chloride in 50 ml of toluene was gradually added dropwise to 15 g of benzylsulfonamide. Thereafter, the stirring was continued for 30 minutes at room temperature. Then, the bath temperature was raised to 110° C., and the reaction mixture was stirred for 3 hours at 110° C. as nitrogen gas was bubbled therethrough. The resulting solution was supplemented with 50 ml of toluene, and allowed to stand till the temperature thereof dropped to room temperature. The crystals precipitated were filtered off, washed with hexane, and then dried under reduced pressure to give 21.9 g of Compound (I-2-a) (in a 78% yield).

Synthesis of Compound (I-2-b)

Compound (I-2-a) in an amount of 5.0 g was mixed with 3.2 g of 2-methyl-γ-naphthoxazole (I-1-b), and stirred for 5 hours at 130° C. The reaction mixture thus obtained was allowed to stand till the temperature thereof dropped to room temperature, and then mixed with 100 ml of ethyl acetate, followed by 2-hour stirring at room temperature. The crystals thus precipitated were filtered off, washed with ethyl acetate, and then dried under reduced pressure to give 4.28 g of Compound (I-2-b) (in a yield of 54%)

Synthesis of Compound (I-2)

Compound (I-2-b) in an amount of 4.28 g was mixed with 4.5 ml of triethyl orthopropionate, 9.0 ml of pyridine and 4.0 ml of acetic acid, and stirred for 1 hour at bath temperature of 120° C. After cooling, the reaction mixture obtained was admixed with 100 ml of ethyl acetate and 50 ml of hexane to separate into two phases. The viscous liquid phase thus separated was recovered by decantation, and further washed twice in the same manner. After draining off the ethyl acetate and the hexane, the viscous liquid was admixed with 20 ml of methanol to deposit crystals. These crystals were filtered off, and then dissolved again by the addition of methanol and 2 ml of triethylamine with stirring. The filtration of the resulting solution was carried out for dust removal, and the filtrate was concentrated by evaporating the methanol to about 40 ml under reduced pressure. At this point, crystals was deposited. Thereto, 2 ml of acetic acid was further added and cooled in order to complete the separation. These crystals were filtered off, washed with methanol, and then dried under reduced pressure. Thus, 0.62 g of Compound (I-2) was obtained in a yield of 17%. The absorption maximum λmax and extinction coefficient ε of this compound in a methanol solution was 515.4 nm and $1.89\times10^5$ respectively, and pKa1 of this compound was 7.48 and pKa2 thereof was 10.27.

Example 3

Preparation of Octahedral Silver Bromide Emulsion (Emulsion A) and Tabular Silver Bromide Emulsions (Emulsions B and C)

In a reaction vessel were placed 1,000 ml of water, 25 g of demineralized ossein gelatin, 15 ml of a 50% aqueous solution of $NH_4NO_3$ and 7.5 ml of 25% aqueous ammonia. These ingredients were mixed well with stirring while the reaction vessel was kept at 50° C. Thereto, 750 ml of a 1N aqueous solution of silver nitrate and a 1 mole/1 aqueous solution of potassium bromide were added over a period of 50 minutes. During the reaction, the Ag potential was kept at −40 mV. The silver bromide grains thus prepared were octahedral in crystal shape, and the equivalent sphere diameter thereof was 0.846±0.036 μm. Further, the emulsion prepared was cooled, and thereto a copolymer of isobutene and monosodium maleate was added as a flocculant to remove salts therefrom by sedimentation washing. The thus desalted emulsion was admixed with 95 g of deionized ossein gelatin and 430 ml of water, and adjusted to pH 6.5 and pAg 8.3 under the temperature of 50° C. Thereafter, the resulting emulsion was sensitized to the optimum by the addition of potassium thiocyanate, chloroauric acid and sodium thiosulfate and 50 minutes' ripening at 55° C. This emulsion was referred to as Emulsion A.

In 1.2 liter of water were dissolved 6.4 g of potassium bromide and 6.2 g of low molecular weight gelatin having an average molecular weight of 15,000 or less. While keeping this solution at 30° C., 8.1 ml of a 16.4% aqueous solution of silver nitrate and 7.2 ml of a 23.5% of aqueous solution of potassium bromide were added thereto over a 10-second period in accordance with a double jet method. The emulsion obtained was admixed with a 11.7% aqueous solution of gelatin, heated up to 75° C., and ripened for 40 minutes. Then, 370 ml of a 32.2% aqueous solution of silver nitrate and a 20% aqueous solution of potassium bromide were further added thereto over a period of 10 minutes while keeping the silver potential at −20 mV. The resulting emulsion underwent 1-minute physical ripening, and cooled to 35° C. Thus, a monodisperse emulsion comprising tabular silver bromide grains having an average projected area diameter of 2.32 μm, a thickness of 0.09 μm and a variation coefficient of 15.1% with respect to the grain diameter (specific gravity: 1.15) was obtained. Further, soluble salts were removed therefrom by agglomeration method. The resulting emulsion was kept at 40° C., and thereto were added 45.6 g of gelatin, 10 ml of a 1 mole/1 aqueous solution of sodium hydroxide, 167 ml of water and 1.66 ml of a 35% phenoxyethanol, followed by adjustment to pAg 8.3 and pH 6.20.

The thus adjusted emulsion was sensitized to the optimum by the addition of potassium thiocyanate, chloroauric acid and sodium thiosulfate and 50 minutes' ripening at 55° C. This emulsion was referred to as Emulsion B.

Instead of using the combination of potassium thiocyanate, chloroauric acid and sodium thiosulfate in the foregoing chemical sensitization, the combination of potassium thiocyanate, chloroauric acid, pentafluorophenyldiphenylphosphine selenide and sodium thiosulfatle was used for chemical sensitization. The thus obtained emulsion was referred to as Emulsion C. The one-layer saturation coverage of Emulsion A and that of Emulsion B were $5.4\times10^{-4}$ and $1.42\times10^{-3}$ mole/mole Ag respectively when the dye occupation area was taken as 80 Å$^2$.

Each emulsion was kept at 50° C., and thereto the first dye shown in Table 1 was added and stirred for 30 minutes, and then the second and third dyes shown in Table 1 were sequentially added and further stirred for 30 minutes at 50° C.

TABLE 1

| | Emulsion | First dye (amount added, mol/mol Ag) | Second dye (amount added, mol/mol Ag) | Third dye (amount added, mol/mol Ag) |
|---|---|---|---|---|
| Comparative Embodiment 1 | B | Dye 1 ($1.56\times10^{-3}$) | | |
| Comparative Embodiment 2 | B | Dye 1 ($1.56\times10^{-3}$) | Dye 1 ($1.56\times10^{-3}$) | Dye 3 ($1.56\times10^{-3}$) |
| Present Embodiment 1 | B | I-1 ($1.56\times10^{-3}$) | I-1 ($3.12\times10^{-3}$) | |
| Present Embodiment 2 | C | I-3 ($1.56\times10^{-3}$) | *I-3 ($1.56\times10^{-3}$) | Dye 4 ($1.56\times10^{-3}$) |

*After the emulsion was adjusted to pH 10, I-3 and Dye 4 were added thereto sequentially, and then the pH was gradually lowered to 5.8. Additionally, I-3 deposited from the emulsion when it was added to the emulsion having ordinary pH value Dye 1

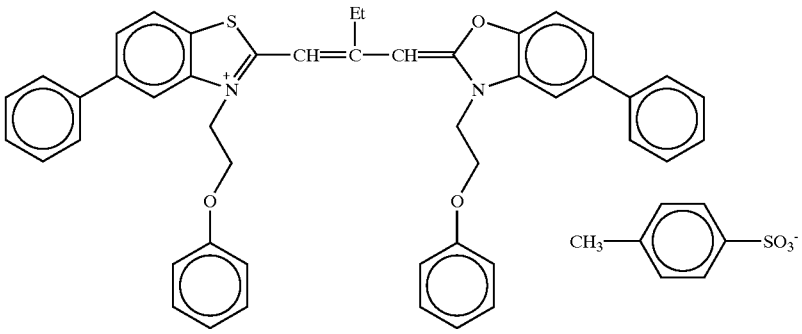

Dye 2

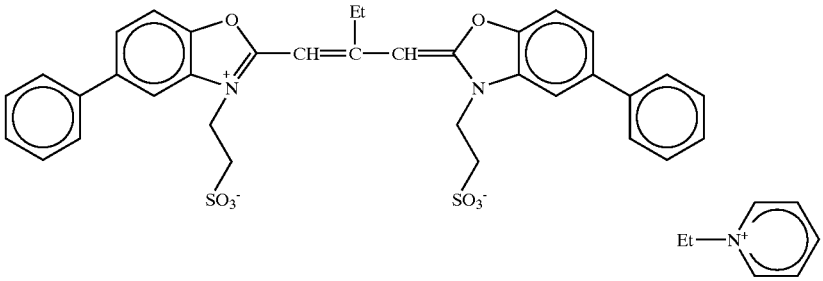

Dye 3

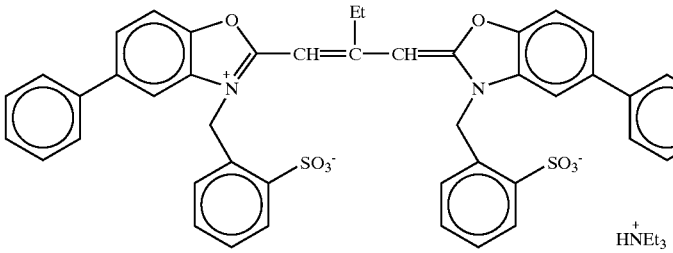

Dye 4

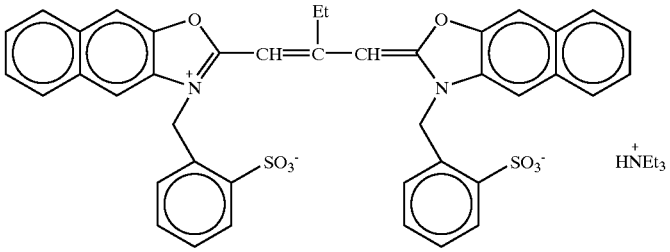

Dye 5

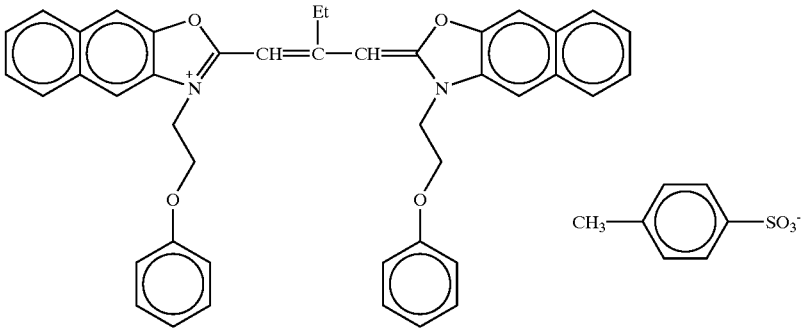

The quantity of dyes adsorbed was determined as follows: Each liquid emulsion prepared was settled using a centrifuge for 10 minutes at 10,000 rpm. The sediment obtained was freeze-dried, and then 0.05 g thereof was added to 25 ml of a 25% aqueous solution of sodium thiosulfate, and further methanol was added thereto to adjust the total volume to 50 ml. This solution was analyzed by high-performance liquid chromatography to determine the dye concentration.

The measurement of light absorption intensity per unit area was made as follows: Each emulsion obtained was coated in a thin layer on a slide glass, and transmission and reflection spectra of individual emulsion grains in the coating were measured with a microspectrophotometer MSP65 made by Carl Zeiss A. G., thereby determining the absorption spectrum. Herein, the transmission spectrum of the grain-free part in the coating was taken as a reference transmission spectrum, and the reflection spectrum of silicon carbide having already known reflectance was employed as a reference reflection spectrum. The measured part was a circular aperture part having a diameter of 1 $\mu$m, and the measuring position was adjusted so that the aperture part didn't overlap with the outline of a grain. The transmission and reflection spectra of each grain were measured in the wavelength region of 14,000 $cm^{-1}$ (714 nm) to 28,000 $cm^{-1}$ (357 nm), and the absorption spectrum was determined taking the absorptance A as 1−T (transmittance) −R (reflectance). The absorptance obtained by subtracting the absorptance of silver halide from the absorptance A was represented by A', and one-half the value obtained by integrating −Log(1−A') with respect to wave number ($cm^{-1}$) was defined as the light absorption intensity per unit surface area. The integrating range therein was from 14,000 $cm^{-1}$ to 28,000 $cm^{-1}$. In the spectral measurements, a tungsten lamp was used as a light source, and the light source voltage was set at 8 V. In order to minimize the damage to dyes resulting from irradiation with light, a primary-side monochrometer was used, and the spacing between wavelengths was adjusted to 2 nm and the slit width was adjusted to 2.5 nm.

By the use of Kubelka-Munk's function, the absorption spectrum of dyes alone was converted from the infinite diffusion reflectivity of the finished emulsion with reference to the dye-free emulsion.

The spectral sensitivity of a coating film was determined by exposing the coating film by means of a spectral exposure apparatus controlled so that the number of photons in each wavelengths was identical in the wavelength region of exposure light, and measuring the exposure required for providing the density of fog+0.2.

After adding a gelatin hardener and a coating aid to the emulsion prepared, the resulting emulsion was coated on a cellulose acetate film support at a silver coverage of 30 $g/m^2$ simultaneously with a protective gelatin layer. The film obtained was exposed to tungsten light (color temperature: 2854° K) for 1 second via a continuous wedge color filter. The color filter used therein was a Fuji Gelatin Filter SC-50 (made by Fuji Photo Film Co., Ltd.) for minus blue exposure by which dyes were excited. By the use of such a filter, light of wavelengths of 500 nm or below was cut off. The thus exposed samples were each developed for 10 minutes at 20° C. by the use of the following surface developer MAA-1.

| Composition of Surface Developer MAA-1: | |
|---|---|
| Metol | 2.5 g |
| L-ascorbic acid | 10 g |
| Nabox (produced by Fuji Photo Film Co., Ltd.) | 35 g |
| Potassium bromide | 1 g |
| Water to make | 1 liter |
| pH | 9.8 |

The developed films were examined for optical density by means of an automatic densitometer (made by Fuji Photo Film Co., Ltd.), and the sensitivities thereof were determined. Therein, each sensitivity was defined as the reciprocal of the exposure amount required for an optical density of fog+0.2. The sensitivities shown in Table 2 are shown as relative values, with the comparative Embodiment 1, to which Dye 1 alone was added, being taken as 100.

The results obtained are shown in Table 2.

TABLE 2

| | Quantity of dyes adsorbed (1) ($10^{-3}$ mol/mol Ag) | Number of adsorbed dye layers | Light absorption intensity (2) | Absorption width (3) (80%, 50% of Amax) | Spectral sensitivity width (80%, 50% of Smax | Minus blue sensitivity (4) | Residual color (5) |
|---|---|---|---|---|---|---|---|
| Comparative Embodiment 1 | 1.44 | 1.00 | 99 | 19, 77 | 31, 79 | 100 | C |
| Comparative Embodiment 2 | 3.01 | 2.09 | 189 | 83, 127 | 58, 131 | 180 | C |
| Present Embodiment 1 | 3.39 | 2.35 | 221 | 23, 92 | 41, 94 | 219 | A |
| Present Embodiment 2 | 3.68 | 2.56 | 242 | 24, 93 | 42, 95 | 239 | B |

(1) Sum of quantities of individual dyes adsorbed.
(2) Light absorption intensity determined by microspectrophotometry.
(3) Value determined from the diffusion reflection spectrum of each emulsion and the sepctrum after conversion by Kubelka-Munk's function.
(4) Relative values, with the emulsion to which Dye 1 alone was added (Compartive Embodiment 1) being taken as 100.
(5) Residual color graded according to three ranks, A (relatively good), C (relatively bad) and B (intermediate between A and C).

As is apparent from the results of Table 2, only the present embodiments enabled the achievement of high sensitivities in the desired wavelength region alone to improve color separation and color reproduction, and further had improvements in residual color (i.e., remaining color) and sensitivity.

In addition, it was confirmed that the same results as mentioned above were attained also in the case of using Emulsion A instead of Emulsions B and C respectively.

Example 4

An internally latent image type direct-positive emulsion comprising octahedral pure silver bromide grains having a projected area-equivalent circle diameter of 0.56 $\mu$m was prepared according to the process for preparing internally latent image type direct-positive octahedral silver halide emulsions as disclosed in Example 1 of Japanese Patent Application No. 11-89801.

The emulsion obtained had a specific gravity of 1.10, a silver content of 61.7 g per kg of emulsion and a gelatin content of 4.85%.

To this emulsion, the dyes shown in Table 3 were added as the emulsion temperature was kept at 60° C.

TABLE 3

| | First dye (amount added, mol/mol Ag) | Second dye (amount added mol/mol Ag) | Addition method* |
|---|---|---|---|
| Comparative Embodiment 3 | Dye 1 ($0.74 \times 10^{-3}$) | Dye 5 ($1.48 \times 10^{-3}$) | (A) |
| Comparative Embodiment 4 | Dye 1 ($0.74 \times 10^{-3}$) | Dye 5 ($1.48 \times 10^{-3}$) | (B) |
| Present Embodiment 3 | Dye 1 ($0.74 \times 10^{-3}$) | I-1 ($1.48 \times 10^{-3}$) | (A) |
| Present Embodiment 4 | Dye 1 ($0.74 \times 10^{-3}$) | I-1 ($1.48 \times 10^{-3}$) | (B) |

*The dyes were added to each emulsion in accordance with the following method (A) or (B):
(A) The first dye was added to the emulsion prepared in the foregoing process. The resulting emulsion was stirred for 30 minutes at 60° C., and then the temperature thereof was lowered to 40° C. Thereto, the second dye was added, and further stirred for 20 minutes at 40° C.
(B) The first dye was added to the emulsion prepared in the foregoing process. The resulting emulsion was stirred for 30 minutes at 60° C., and then the temperature thereof was lowered to 40° C. Thereafter, the emulsion was adjusted to pH 7.5, and thereto was added the second dye. The pH of the resulting emulsion was lowered gradually to 5.8 as the emulsion temperature was kept at 40° C.

These emulsions were each examined for the quantity of sensitizing dyes adsorbed in the same way as in Example 3, and coated on a cellulose acetate film support in the same manner as in Example 3 to prepare samples for evaluation of photographic properties.

The samples prepared were each exposed in the same manner as in Example 3, bleached for 3 minutes at 20° C. with the following bleaching bath, and then developed for 3.5 minutes at 20° C. in the total developer described below.

The sensitivity determination was made according to the same method as adopted in Example 3. Therein, the sensitivity was defined as the reciprocal of the exposure amount required for an optical density of fog+0.1. The sensitivities set forth in Table 4 are shown as relative values, with the case of adding Dye 1 alone in Comparative Embodiment 3 being taken as 100.

The results obtained are shown in Table 4.

| Bleaching Bath | |
|---|---|
| Phenosafranine | 0.0123 g |
| Hot water | 75 ml |
| After dissolution | |
| Water | 875 ml |
| Potassium ferricyanide | 3.0 g |
| Water to make | 1,000 ml |
| Total Developer | |
| Metol | 2.2 g |
| Sodium sulfite | 96.0 g |
| Hydroquinone | 8.8 g |
| Sodium carbonate monohydrate | 56.0 g |

-continued

| | |
|---|---|
| Potassium bromide | 5.0 g |
| Potassium iodide | 0.5 g |
| water to make | 1,000 ml |

TABLE 4

| | Quantity of dyes added (mmol/mol Ag) | Number of adsorbed-dye layers | Light absorption intensity | Sensitivity |
|---|---|---|---|---|
| Comparative Embodiment 3 | 1.51 | 1.91 | 171 | 188 |
| Comparative Embodiment 4 | 1.54 | 1.93 | 169 | 179 |
| Present Embodiment 3 | 2.09 | 2.52 | 220 | 209 |
| Present Embodiment 4 | 2.69 | 3.11 | 301 | 290 |

Additionally, in the case where the first dye alone was added in Comparative Embodiment 3, the quantity of dye adsorbed was 0.7 mmol/mol Ag, the number of adsorbed-dye layers was 0.9 and the light absorption intensity was 76.

As shown in Table 4, the quantity of dyes adsorbed, the number of adsorbed-dye layers, the light absorption intensity and the spectral sensitivity were all higher in the embodiments according to the invention than the comparative embodiments using comparative dyes alone.

Further, the present embodiments enabled multilayer adsorption of sensitizing dyes in a J-aggregated state to achieve spectral sensitization in a narrow wavelength region.

Example 5

An internally latent image type direct-positive emulsion comprising hexagonal tabular silver bromide grains having an average projected area-equivalent circle diameter of 2.20 μm and a thickness of 0.38 μm (Emulsion 5-0) was prepared according to the process for preparing an internally latent image type direct-positive hexagonal tabular silver halide emulsion (Emulsion T) as disclosed in Example 1 of Japanese Patent Application No. 11-89801.

The emulsion thus prepared was kept at 60° C., and thereto the first dye as shown in Table 5 was added and stirred for 30 minutes. After lowering the emulsion temperature to 40° C., 2-{4-[3-(3-phenylthioureido)benzoylamino]phenyl}-1-formyl-hydrazine as a nucleation agent was added thereto in an amount of 0.061 mmole per mole of silver. After a lapse of 5 minutes, the resulting emulsion was admixed with the second dye as shown in Table 4 and stirred for 15 minutes. Thus, Emulsions 5-1 to 5-3 were obtained. The total quantity of sensitizing dyes adsorbed to each of these emulsions was determined in the same manner as in Example 3.

Then, a comparative sample 5-0 was prepared in the same manner as the comparative photosensitive Element 101 disclosed in Example 1 of Japanese Patent Application No.11-89801, except that the 13th layer was excluded and the emulsion used for the 14th layer (Emulsion A-1) was replaced by the foregoing Emulsion 5-0.

Further, samples 5-1 to 5-3 were prepared in the same manner as the sample 5-0, except that Emulsions 5-1 to 5-3 prepared in advance were used respectively in the 14th layer in place of the emulsion and the nucleation agent used in the 14th layer of Sample 5-0.

TABLE 5

| | Emulsion | First dye (amount added, mmol/mol Ag) | Second dye (amount added, mmol/mol Ag) | Quantity of dye adsorbed (mmol/mol Ag) | Number of adsorbed-dye layers | Light absorption intensity $cm^{-1} \times mol/m^2$ |
|---|---|---|---|---|---|---|
| Comparative Embodiment 6 | 5-1 | Dye 1 (0.38) | — | 0.36 | 0.88 | 76 |
| Comparative Embodiment 7 | 5-2 | Dye 1 (0.38) | Dye 5 (0.38)<br>Dye 4 (0.38) | 1.11 | 2.58 | 224 |
| Present Embodiment 5 | 5-3 | Dye 1 (0.38) | *I-3 (0.76) | 1.35 | 3.09 | 269 |

*After adding the first dye, the emulsion was adjusted to pH 7.5 at 40° C., then I-3 was added thereto, and further the resulting emulsion was restored to pH 5.8.

The thus prepared samples were each subjected to exposure and spread development at 25° C. in the same manner as disclosed in Example 1 of Japanese Patent Application No. 11-89801. Thereafter, the transferred magenta image densities were measured with a color densitometer, and thereby the sensitivity of each sample was determined. Therein, the sensitivity determination was effected using the same method as disclosed in Example 1 of Japanese Patent Application No. 11-89801. The results obtained are shown in Table 6. The sensitivities shown in Table 6 are shown as relative values, with the sample 5-0 being taken as 100.

TABLE 6

| | Sample | Emulsion | Foot sensitivity |
|---|---|---|---|
| Comparative Embodiment 5 | 5-0 | 5-0 | 100 |
| Comparative Embodiment 6 | 5-1 | 5-1 | 71 |
| Comparative Embodiment 7 | 5-2 | 5-2 | 209 |
| Present Embodiment 5 | 5-3 | 5-3 | 276 |

As to the comparative samples 5-0 and 5-1, addition of the first dye alone was carried out. Therefore, the amount of sensitizing dye added was smaller than the one-layer saturation coverage; as a result, the light absorption intensities and the sensitivities of these samples were low. On the other hand, the present sample 5-3 had high light absorption intensity and high sensitivity, as compared with the comparative sample 5-3. Further, the present sample 5-3 achieved spectral sensitization in the narrow wavelength region because both the sensitizing dye forming the first layer and the sensitizing dye forming the second layer or above were in the J-aggregated state. Thus, the present embodiment was able to attain substantial increases in light absorption intensity and sensitivity in the application to a diffusion transfer multilayer color photosensitive material also.

Example 6

Samples 6-1 and 6-2 were prepared according to the process for preparing the multilayer color photosensitive material (Sample 101) disclosed in Example 5 of JP-A-8-29904.

Specifically, the Emulsion H used in the 9th layer of Sample 101 prepared in Example 5 of JP-A-8-29904 was replaced by the emulsion described in Example 3 of the present invention. More specifically, the sample 6-1 was prepared by substituting the emulsion prepared according to the comparative embodiment 2 described in Example 3 of the invention without adding ExS-4, ExS-5 and Ex-6 used in Example 5 of the reference described above.

And the sample 6-2 was prepared by substituting the emulsion prepared according to the present embodiment 2 described in Example 3 of the invention.

The samples prepared were each exposed for 1/100 second via an optical wedge and a green filter by means of a Fuji FW-type sensitometer (made by Fuji Photo Film Co., Ltd., subjected to the color photographic processing wherein the same processing steps and processing solutions as disclosed in Example 1 of the reference described above were employed, and then examined for magenta density. The results obtained are shown in Table 7. Therein, the sensitivity was defined as the reciprocal of the exposure amount required for giving a density of (fog density+0.2). The sensitivities set forth in Table 6 are shown as relative values, with the sample 6-1 being taken as 100.

TABLE 7

| Sample | Emulsion | Relative sensitivity | Residual color* | Note |
|---|---|---|---|---|
| 6-1 | Comparative Embodiment 2 | 100 (standard) | C | Comparison |
| 6-2 | Present Embodiment 2 | 127 | A | Invention |

*Residual color was graded according to three ranks, A(relatively good), C(relatively bad) and B (intermediate between A and C).

The substantial increase in sensitivity as shown in Table 7 was able to achieved also when the emulsion wherein the amount of sensitizing dyes adsorbed was so greatly increased as to form a multilayer on the silver halide grain surface in accordance with an embodiment of the invention was applied to a negative multilayer color photosensitive material. Further, the present sample 6-2 achieved spectral sensitization in the narrow wavelength region because both the sensitizing dye forming the first layer and the sensitizing dye forming the second layer or above were in the J-aggregated state. In addition, the color contamination was also improved.

Besides being applied to the photographic materials of the aforementioned types, the emulsions according to the present embodiments were able to applied to various other silver halide photographic materials, including X-ray sensitive materials, reversal multilayer color photosensitive materials and heat-developable multilayer color photosensistive materials, and produce almost the same results as obtained in Examples 3, 4, 5 and 6.

EFFECT OF THE INVENTION

When photographic emulsions according to the invention are used in photosensitive materials, they can confer the desired absorption and sensitivity waveforms on the photosensitive materials, and enable the resulting photosensitive materials to have high sensitivity and be reduced in residual color due to multilayer adsorption.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one compound represented by formula (I):

(I)

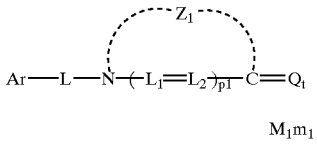

wherein $Q_1$ represents a methine or polymethine group necessary for completing said compound as a methine dye; $Z_1$ represents atoms necessary to complete a 5- or 6-membered nitrogen-containing heterocyclic ring, provided that $Z_1$ may be condensed with a ring; $L_1$ and $L_2$ each represents a methine group; $p_1$ represents 0 or 1; L represents a divalent linking group and Ar represents an aromatic group, provided that L or Ar contains at least one proton dissociative group selected from the group consisting of a sulfonylcarbamoyl group, a sulfonylsulfamoyl group, a carbonylcarbamoyl group, a carbonylsulfamoyl group and a phenolic hydroxyl group as a substituent group or a part of the linking group or the aromatic group and the proton dissociative group has a pKa value of from 3 to 12; $M_1$ represents a counter ion for charge balance; and $m_1$ represents a number of counter ions required for neutralizing charges on the molecule, and ranges from 0 to 10.

2. The silver halide photographic material as in claim 3, wherein $Z_1$ represents at least one nucleus selected from the group consisting of a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus, an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus.

3. The silver halide photographic material as in claim 1, wherein L contains said at least one proton dissociative group.

4. The silver halide photographic material as in claim 1, wherein Ar contains said at least one proton dissociative group.

5. A silver halide photographic material comprising at least one compound represented by formula (II):

(II)

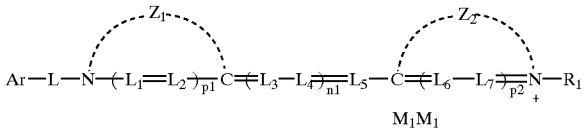

wherein $Z_2$ represents atoms necessary to complete a 5-membered or 6-membered nitrogen-containing heterocyclic ring, provided that $Z_2$ may be condensed with a ring; $L_1$, $L_2$, $L_3$, $L_4$, $L_5$, $L_6$ and $L_7$ each represent a methine group; $R_1$ represents an alkyl group, an aryl group, or a heterocyclic group; $p_2$ represents 0 or 1; $n_1$ represents 0, 1, 2, 3 or 4; $Z_1$ represents atoms necessary to complete a 5- or 6-membered nitrogen-containing heterocyclic ring, provided that $Z_1$ may be condensed with a ring; $p_1$ represents 0 or 1; L represents a divalent linking group and Ar represents an aromatic group, provided that L or Ar contains at least one proton dissociative group as a substituent group or a part of the linking group or the aromatic group and the proton dissociative group has a pKa value of from 3 to 12; $M_1$ represents a counter ion for charge balance; and $m_1$ represents a number of counter ions required for neutralizing charges on the molecule, and ranges from 0 to 10.

6. The silver halide photographic material as in claim 5, wherein $Z_1$ and $Z_2$ each represents at least one nucleus selected from the group consisting of a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus, an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus.

7. The silver halide photographic material as in claim 5, wherein L contains said at least one proton dissociative group.

8. The silver halide photographic material as in claim 5, wherein Ar contains said at least one proton dissociative group.

9. The silver halide photographic material as in claim 5, wherein L or Ar contains at least one proton dissociative group selected from the group consisting of a sulfonylcarbamoyl group, a sulfonylsulfamoyl group, a carbonylcarbamoyl group, a carbonylsulfamoyl group and a phenolic hydroxyl group.

10. A silver halide photographic emulsion comprising silver halide grains having a light absorption intensity of at least 60 at the spectral absorption maximum wavelength of less than 500 nm or having a light absorption intensity of at least 100 at the spectral absorption maximum wavelength of not less than 500 nm, and at least one compound represented by the formula (I):

(I)

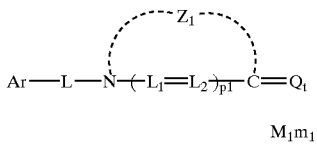

wherein $Q_1$ represents a methine or polymethine group necessary for completing said compound as a methine dye;

$Z_1$ represents atoms necessary to complete a 5- or 6-membered nitrogen-containing heterocyclic ring, provided that $Z_1$ may be condensed with a ring; $L_1$ and $L_2$ each represent a methine group; $p_1$ represents 0 or 1; L represents a divalent linking group and Ar represents an aromatic group, provided that L or Ar contains at least one proton dissociative group as a substituent group or a part of the liking group or aromatic group and the proton dissociative group has a pKa value of from 3 to 12; $M_1$ represents a counter ion for charge balance; and $m_1$ represents a number of counter ions required for neutralizing charges on the molecule, and ranges from 0 to 10.

11. The silver halide photographic emulsion as in claim 10, wherein said compound represented by formula (I) is a compound represented by formula (II):

(II)

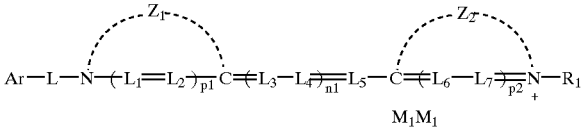

wherein $Z_2$ represents atoms necessary to complete a 5- or 6-membered nitrogen-containing heterocyclic ring, provided that $Z_2$ may be condensed with a ring; $L_3$, $L_4$, $L_5$, $L_6$ and $L_7$ each represent a methine group; $R_1$ represents an alkyl group, an aryl group, or a heterocyclic group; p2 represents 0 or 1; $n_1$ represents 0, 1, 2, 3 or 4; and $Z_1$, $L_1$, $L_2$, $P_1$, L, Ar, $M_1$ and $m_1$ have the same meanings as in the formula (I) respectively.

12. The silver halide photographic emulsion as in claim 10, wherein when the maximum value of the spectral absorption rate of said emulsion due to the sensitizing dye is taken as Amax, a wavelength interval between the shortest wavelength and the longest wavelength showing 50% of Amax is 120 nm or less.

13. The silver halide photographic emulsion as in claim 12, wherein the wavelength interval between the shortest wavelength and the longest wavelength showing to 80% of Amax is 20 nm or more, and the wavelength interval between the shortest wavelength and the longest wavelength showing 50% of Amax is 120 nm or less.

14. The silver halide photographic emulsion as in claim 10, wherein when the maximum value of the spectral sensitivity of said emulsion due to the sensitizing dye is taken as Smax, a wavelength interval between the shortest wavelength and the longest wavelength showing 50% of Smax is 120 nm or less.

15. The silver halide photographic emulsion as in claim 14, wherein the wavelength interval between the shortest wavelength and the longest wavelength showing to 80% of Smax is 20 nm or more, and the wavelength interval between the shortest wavelength and the longest wavelength showing 50% of Smax is 120 nm or less.

16. A silver halide photographic material having at least one silver halide emulsion layer, said emulsion layer comprising a silver halide photographic emulsion as described in claim 10.

17. The silver halide photographic material as in claim 10, wherein L contains said at least one proton dissociative group.

18. The silver halide photographic material as in claim 10, wherein Ar contains said at least one proton dissociative group.

19. The silver halide photographic material as in claim 10, wherein L or Ar contains at least one proton dissociative group selected from the group consisting of a sulfonylcarbamoyl group, a sulfonylsulfamoyl group, a carbonylcarbamoyl group, a carbonylsulfamoyl group and a phenolic hydroxyl group.

20. The silver halide photographic material as in claim 10, wherein $Z_1$ represents at least one nucleus selected from the group consisting of a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus, an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus.

21. A method for preparing a silver halide photographic emulsion, said method comprising:

adding a compound represented by formula (I) to a silver halide photographic emulsion having a pH value higher than the pKa value of first or second dissociation of a proton dissociative group contained in said compound; and adjusting the pH of the compound-added emulsion to a value lower than the pKa value of first or second dissociation of the proton dissociative group:

(I)

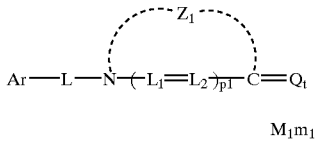

wherein $Q_1$ represents a methine or polymethine group necessary for completing said compound as methine dye; $Z_1$ represents atoms necessary to complete a 5- or 6-membered nitrogen-containing heterocyclic ring, provided that $Z_1$ may be condensed with a ring; $L_1$ and $L_2$ each represent a methine group; $p_1$ represents 0 or 1; L represents a divalent linking group and Ar represents an aromatic group, provided that L or Ar contains at least one proton dissociative group selected from the group consisting of a sulfonylcarbamoyl group, a sulfonylsulgfamoyl group, a carbonylcarbamoyl group, a carbonylsulfamoyl group and a phenolic hydroxyl group as a substituent group, a carbonylsufamoyl group and a phenolic hydroxyl group as a substituent group or a part of the linking group or the aromatic group and the proton dissociative group has pKa value of from 3 to 12; $M_1$ represents a counter ion for charge balance; and $m_1$ represents a number of counter ions required for neutralizing chages on the molecule, and ranges form 0 to 10.

22. A silver halide photographic material comprising a silver halide emulsion prepared by a method according to claim 21.

23. A method for preparing a silver halide photographic emulsion, said method comprising:

adding a compound represented by formula (II) to a silver halide photographic emulsion having a pH value higher than the pKa value of first or second dissociation of a proton dissociative group contained in said compound; and adjusting the pH of the compound-added emulsion to value lower than the pKa value of first or second dissociation of the proton dissociative group:

(II)

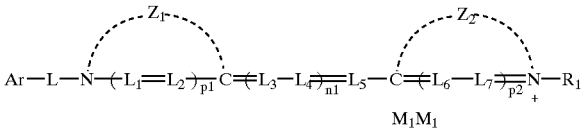

wherein $Z_2$ represents atoms necessary to complete 5-membered or 6-membered nitrogen-containing heterocyclic being, provided that $Z_2$ may be condensed with a ring; $L_1$, $L_2$, $L_3$, $L_4$, $L_5$, $L_6$ and each represent a methine group; $R_1$ represents an alkyl group, an aryl group, or a heterocyclic group; $p_2$ represents 0 or 1; $n_1$ represents 0, 1, 2, 3 or 4; $Z_1$ represents atoms necessary to complete a 5- or 6-membered nitrogen-containing heterocyclic ring, provided that $Z_1$ may be condensed with a ring; $p_1$ represents 0 or 1; L represents a divalent lining group and Ar represents an aromatic group, provided that L or Ar contains at least one portion dissociative group as a substituent group or a part of the linking group or the aromatic group and the proton dissociative group has a pKa value of from 3 to 12; $M_1$ represents a counter ion for charge balance; and $m_1$ represents a number of counter ions required for neutralizing charges on the molecule, and ranges from 0 to 10.

24. A silver halide photographic material comprising a silver halide emulsion prepared by the method claim 23.

* * * * *